US009809409B2

(12) United States Patent
Tominaga et al.

(10) Patent No.: US 9,809,409 B2
(45) Date of Patent: Nov. 7, 2017

(54) PRINTING SYSTEM AND CONTROL METHOD THEREFOR

(71) Applicant: Canon Kabushiki Kaisha, Tokyo (JP)

(72) Inventors: Masahiko Tominaga, Kawasaki (JP); Yuuki Maeda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/874,602

(22) Filed: Oct. 5, 2015

(65) Prior Publication Data

US 2016/0023860 A1 Jan. 28, 2016

Related U.S. Application Data

(63) Continuation of application No. 11/838,206, filed on Aug. 13, 2007.

(30) Foreign Application Priority Data

Aug. 18, 2006 (JP) ..... 2006-223514

(51) Int. Cl.
*G06F 15/00* (2006.01)
*B65H 31/24* (2006.01)
(Continued)

(52) U.S. Cl.
CPC ..... *B65H 31/24* (2013.01); *B65H 7/20* (2013.01); *B65H 37/00* (2013.01); *B65H 39/10* (2013.01);
(Continued)

(58) Field of Classification Search
CPC ..... B65H 31/24
(Continued)

(56) References Cited

U.S. PATENT DOCUMENTS 3,907,274 A 9/1975 D'Amato et al.
5,204,728 A * 4/1993 Braswell ..... G03G 15/6538 399/361
(Continued)

FOREIGN PATENT DOCUMENTS

CN 1531506 A 9/2004
CN 1689948 A 11/2005
(Continued)

OTHER PUBLICATIONS

Machine translation of Japanese Patent Document No. 2004-251971, Kurohata, Sep. 9, 2004.*
(Continued)

*Primary Examiner* — Mark Milia
(74) *Attorney, Agent, or Firm* — Rossi, Kimms & McDowell LLP

(57) ABSTRACT

A printing system adapted to supply printed materials from a printing apparatus to a first stacking unit of a first sheet processing apparatus and a second stacking unit of a second sheet processing apparatus is provided. The system includes a receiver and controller, the receiver receiving via a user interface unit a specified instruction allowing the printing system to perform a first type operation that both the first stacking unit and the second stacking unit can be used in printing a job to be processed, the controller causing the printing apparatus to perform the first type operation wherein the specified instruction is received, and the controller causing the printing apparatus to perform a second type operation wherein the specified instruction is not received, the second type operation wherein one of the first stacking unit and the second stacking unit can be used in printing a job to be processed.

20 Claims, 23 Drawing Sheets

(51) Int. Cl.

| | |
|---|---|
| ***B65H 39/10*** | (2006.01) |
| ***B65H 7/20*** | (2006.01) |
| ***B65H 37/00*** | (2006.01) |
| ***B65H 43/00*** | (2006.01) |

(52) U.S. Cl.
CPC ..... *B65H 43/00* (2013.01); *B65H 2301/16* (2013.01); *B65H 2511/414* (2013.01); *B65H 2513/42* (2013.01); *B65H 2551/00* (2013.01); *B65H 2801/15* (2013.01)

(58) Field of Classification Search
USPC ..... 358/1.13
See application file for complete search history.

(56) References Cited

U.S. PATENT DOCUMENTS

| | | | | |
|---|---|---|---|---|
| 5,547,178 | A | 8/1996 | Costello | |
| 5,583,617 | A | 12/1996 | Altrieth et al. | |
| 5,640,232 | A | 6/1997 | Miyake et al. | |
| 5,706,411 | A | 1/1998 | McCormick et al. | |
| 6,486,968 | B2 | 11/2002 | Nishikawa | |
| 7,072,052 | B1 | 7/2006 | Tanahashi et al. | |
| 7,202,964 | B2 | 4/2007 | Christiansen | |
| 7,567,844 | B2 | 7/2009 | Thomas et al. | |
| 8,159,693 | B2 | 4/2012 | Namikata | |
| 8,848,212 | B2 | 9/2014 | Shimada | |
| 2002/0026463 | A1 | 2/2002 | Utsunomiya | |
| 2002/0171864 | A1 | 11/2002 | Sesek | |
| 2003/0067618 | A1 | 4/2003 | Farrell et al. | |
| 2003/0098987 | A1 | 5/2003 | Fiske | |
| 2004/0061892 | A1 | 4/2004 | Ferlitsch | |
| 2004/0098148 | A1 | 5/2004 | Retlich et al. | |
| 2004/0207153 | A1 | 10/2004 | Kida | |
| 2005/0017426 | A1 | 1/2005 | Hirata et al. | |
| 2005/0084277 | A1 | 4/2005 | Kushida | |
| 2005/0105117 | A1 | 5/2005 | Oh et al. | |
| 2005/0105129 | A1 | 5/2005 | Takahashi | |
| 2005/0141030 | A1 | 6/2005 | Tuchitoi et al. | |
| 2005/0220475 | A1 | 10/2005 | Kasahara | |
| 2005/0232656 | A1* | 10/2005 | Asai | B42C 19/02 399/130 |
| 2006/0092432 | A1 | 5/2006 | Ferlitsch | |
| 2007/0019224 | A1 | 1/2007 | Okada et al. | |
| 2007/0024891 | A1 | 2/2007 | Kim | |
| 2007/0085263 | A1 | 4/2007 | Machida et al. | |
| 2008/0055637 | A1 | 3/2008 | Hatakeyama | |

FOREIGN PATENT DOCUMENTS

| | | | |
|---|---|---|---|
| CN | 1702565 | A | 11/2005 |
| EP | 1130480 | A2 | 9/2001 |
| JP | 11147647 | A | 6/1999 |
| JP | 2000159416 | A | 6/2000 |
| JP | 2000238385 | A | 9/2000 |
| JP | 2000318913 | A | 11/2000 |
| JP | 2002297356 | A | 10/2002 |
| JP | 2002362821 | A | 12/2002 |
| JP | 2003054830 | A | 2/2003 |
| JP | 2003228471 | A | 8/2003 |
| JP | 2003326810 | A | 11/2003 |
| JP | 2004251971 | A | 9/2004 |
| JP | 2004284826 | A | 10/2004 |
| JP | 2004310746 | A | 11/2004 |
| JP | 2004310747 | A | 11/2004 |
| JP | 2005258151 | A | 9/2005 |
| JP | 2006078747 | A | 3/2006 |
| JP | 2006199022 | A | 8/2006 |

OTHER PUBLICATIONS

Extended European Search Report issued in EP07115176.5, dated Nov. 7, 2011.
Chinese Office Action issued in CN201210385060.0, dated Sep. 24, 2014. English translation provided.
Chinese Office Action cited in CN201210384459.7, dated Sep. 25, 2014. English translation provided.
Machine translation of Japanese Patent Document No. 2004-251971, Kurohata et al., Sep. 9, 2004.
Japanese Office Action cited in JP2013004041, dated Jan. 6, 2014.
Japanese Office Action issued in JP2006223514, dated Nov. 12, 2012.
Japanese Office Action issued in JP2006223514, dated Jun. 4, 2012.
Japanese Office Action issued in JP2006223514, dated Nov. 25, 2011.
Korean Office Action issued in KR10-2007-0087896, dated May 11, 2009.
Chinese Office Action issued in CN2007101387806, dated Apr. 3, 2009.
Non-Final Office Action issued in U.S. Appl. No. 11/838,206, dated Jun. 21, 2011.
Final Office Action issued in U.S. Appl. No. 11/838,206, dated Dec. 8, 2011.
Non-Final Office Action issued in U.S. Appl. No. 11/838,206, dated May 24, 2012.
Final Office Action issued in U.S. Appl. No. 11/838,206, dated Dec. 13, 2012.
Non-Final Office Action issued in U.S. Appl. No. 11/838,206, dated Aug. 27, 2013.
Final Office Action issued in U.S. Appl. No. 11/838,206, dated Apr. 22, 2014.
Non-Final Office Action issued in U.S. Appl. No. 11/838,206, dated Dec. 31, 2014.
Final Office Action issued in U.S. Appl. No. 11/838,206, dated Jul. 15, 2015.

* cited by examiner

PRINTING SYSTEM AND CONTROL METHOD THEREFOR

BACKGROUND OF THE INVENTION

Field of the Invention

The present invention relates to a printing system adapted to be able to supply materials printed by a printing apparatus to either the destination of the first sheet processing apparatus or that of the second sheet processing apparatus, and a control method therefor.

Description of the Related Art

Recently, a POD (Print On Demand) printing system using an electrophotographic or inkjet printing apparatus has been proposed (see, e.g., patent reference 1: Japanese Patent Laid-Open No. 2004-310746, and patent reference 2: Japanese Patent Laid-Open No. 2004-310747).

In the POD environment, there is a dolly-attached sheet processing apparatus also called a large-volume stacker which outputs many printed materials and assumes the use of a sheet processing apparatus. There are also prepared a printing apparatus capable of connecting a plurality of large-volume stackers, and a printing apparatus connected to even a stapler, saddle stitching apparatus, and the like in order to perform various inline finishing processes.

However, before a printing apparatus connected to a plurality of large-volume stackers completes printing of a job accompanied by output of many pages, one large-volume stacker may become fully loaded with output materials, failing to complete the output. In this case, the user may want to continue printing by switching the output to another large-volume stacker, or may want to print out materials to the same large-volume stacker. In the former case, the user wants to take out a pile of printed materials at once or continue printing even while removing output materials from the fully loaded large-volume stacker. In the latter case, the user has a plurality of dollies, and the time until a dolly is mounted again in the fully loaded large-volume stacker is short, or offline finishing processing is determined for each large-volume stacker.

That is, a printing apparatus connected to a plurality of large-volume stackers must cope with various destinations of printed materials in accordance with the number of output sheets of a job and the user environment (e.g., the number of dollies or a cooperation flow to an offline finishing process).

SUMMARY OF THE INVENTION

The present invention provides a convenient printing system adaptable not only to the office environment but also to the POD environment, and a control method therefor.

Moreover, the present invention provides a mechanism of minimizing intervention work by an operator that may occur in the POD environment due to the specifications of an image forming apparatus designed in consideration of only the office environment. It is possible to implement efficient work by reducing the work-load of the operator.

Furthermore, the present invention to provide a mechanism capable of flexibly coping with various needs from various users as much as possible in consideration of various situations and use environments.

According to one aspect of the present invention, there is provided a printing system adapted to be able to supply printed materials from a printing apparatus to a first stacking unit of a first sheet processing apparatus and a second stacking unit of a second sheet processing apparatus, the system comprising: a receiver that receives via a user interface unit a specified instruction that allows the printing system to perform a first type operation, the first type operation being an operation that both the first stacking unit and the second stacking unit can be used in printing of a job to be processed; and a controller that causes the printing apparatus to perform the first type operation in a case where the specified instruction is received, the controller causing the printing apparatus to perform a second type operation in a case where the specified instruction is not received, the second type operation being an operation that one of the first stacking unit and the second stacking unit can be used in printing of a job to be processed.

According to another aspect of the present invention, there is provided a method for printing system adapted to be able to supply printed materials from a printing apparatus to a first stacking unit of a first sheet processing apparatus and a second stacking unit of a second sheet processing apparatus, the method for comprising: receiving via a user interface unit a specified instruction that allows the printing system to perform a first type operation, the first type operation being an operation that both the first stacking unit and the second stacking unit can be used in printing of a job to be processed; causing the printing apparatus to perform the first type operation in a case where the specified instruction is received; and causing the printing apparatus to perform a second type operation in a case where the specified instruction is not received, the second type operation being an operation that one of the first stacking unit and the second stacking unit can be used in printing of a job to be processed.

Further features of the present invention will become apparent from the following description of exemplary embodiments with reference to the attached drawings.

DESCRIPTION OF THE EMBODIMENTS

The best mode for carrying out the present invention will be explained in detail below with reference to the accompanying drawings.

Figure 1:
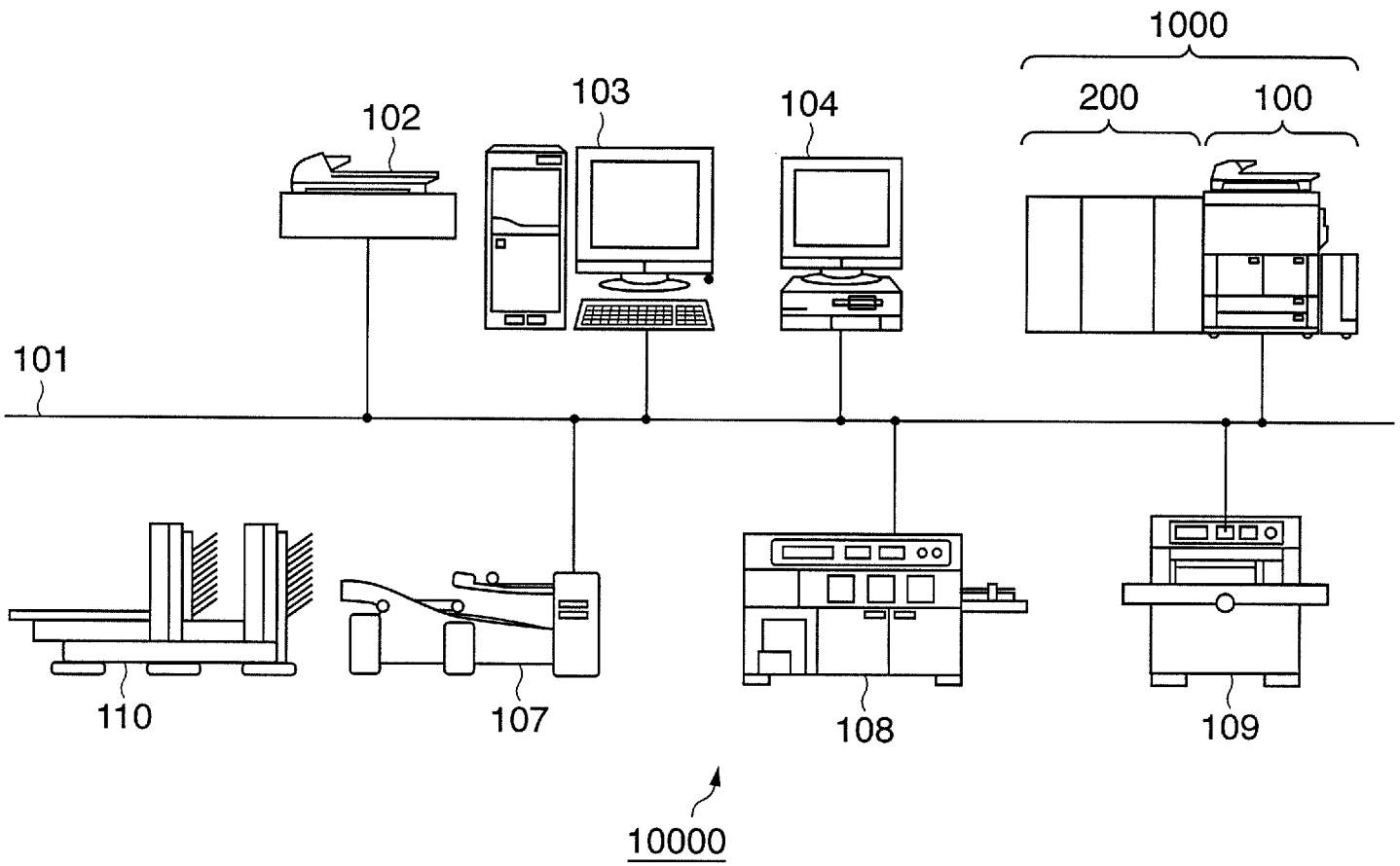
FIG. 1 is a view for explaining an overall configuration of a printing environment 10000 including a printing system 1000 to be controlled.

A POD system 10000 in FIG. 1 comprises a printing system 1000, scanner 102, server computer (PC) 103, and client computer (PC) 104, which are connected to each other via a network 101. Sheet processing apparatuses such as a paper folding apparatus 107, case binding apparatus 108, cutting apparatus 109, and saddle stitching apparatus 110 are also connected to the POD system 10000.

The printing system 1000 comprises a printing apparatus 100 and sheet processing apparatus 200. As an example of the printing apparatus 100, the embodiment will describe an MFP (Multi Function Peripheral) having a plurality of functions such as the copy and printer functions. However, the printing apparatus 100 may be a single function type printing apparatus having only the copy or printer function.

The server computer (PC) 103 manages data exchange with a variety of apparatuses connected to the network 101. The client computer (PC) 104 transmits image data to the printing apparatus 100 and PC 103 via the network 101. The paper folding apparatus 107 folds sheets printed by the printing apparatus 100. The case binding apparatus 108 case-binds sheets printed by the printing apparatus 100. The cutting apparatus 109 cuts a bundle of sheets printed by the printing apparatus 100. The saddle stitching apparatus 110 saddle-stitches sheets printed by the printing apparatus 100.

In the use of the paper folding apparatus 107, case binding apparatus 108, cutting apparatus 109, and saddle stitching apparatus 110, the user takes out sheets printed by the printing apparatus 100 from the printing system 1000, sets them in an apparatus for use, and causes the apparatus to process them. A plurality of apparatuses in the POD system 10000 of FIG. 1 except for the saddle stitching apparatus 110 are connected to the network 101 so as to communicate data with each other.

Sheet processing apparatuses are classified into three categories "inline finisher", "near-line finisher", and "offline finisher", and defined as follows. The "inline finisher" is defined as a sheet processing apparatus which satisfies both (condition 1) and (condition 2) listed below. The "near-line finisher" is defined as a sheet processing apparatus which satisfies only (condition 2). The "offline finisher" is defined as a sheet processing apparatus which satisfies neither (condition 1) nor (condition 2).

(Condition 1) The paper path (sheet feeding path) is physically connected to the printing apparatus 100 so as to directly receive sheets conveyed from the printing apparatus 100 without any operator intervention.

(Condition 2) A sheet processing apparatus is electrically connected to another apparatus so as to communicate data necessary for an operation instruction, status confirmation, or the like with another apparatus. More specifically, a sheet processing apparatus is electrically connected to the printing apparatus 100 so as to communicate data with it, or electrically connected to an apparatus (e.g., the PC 103 or 104) other than the printing apparatus 100 via the network 101 so as to communicate data with the apparatus. A sheet processing apparatus which satisfies either condition meets (condition 2).

That is, the sheet processing apparatus 200 corresponds to an "inline finisher". The paper folding apparatus 107, case binding apparatus 108, and cutting apparatus 109 correspond to "near-line finishers". The saddle stitching apparatus 110 corresponds to an "offline finisher".

The configuration of the printing system 1000 will be explained with reference to the system block diagram of FIG. 2.

Figure 2:
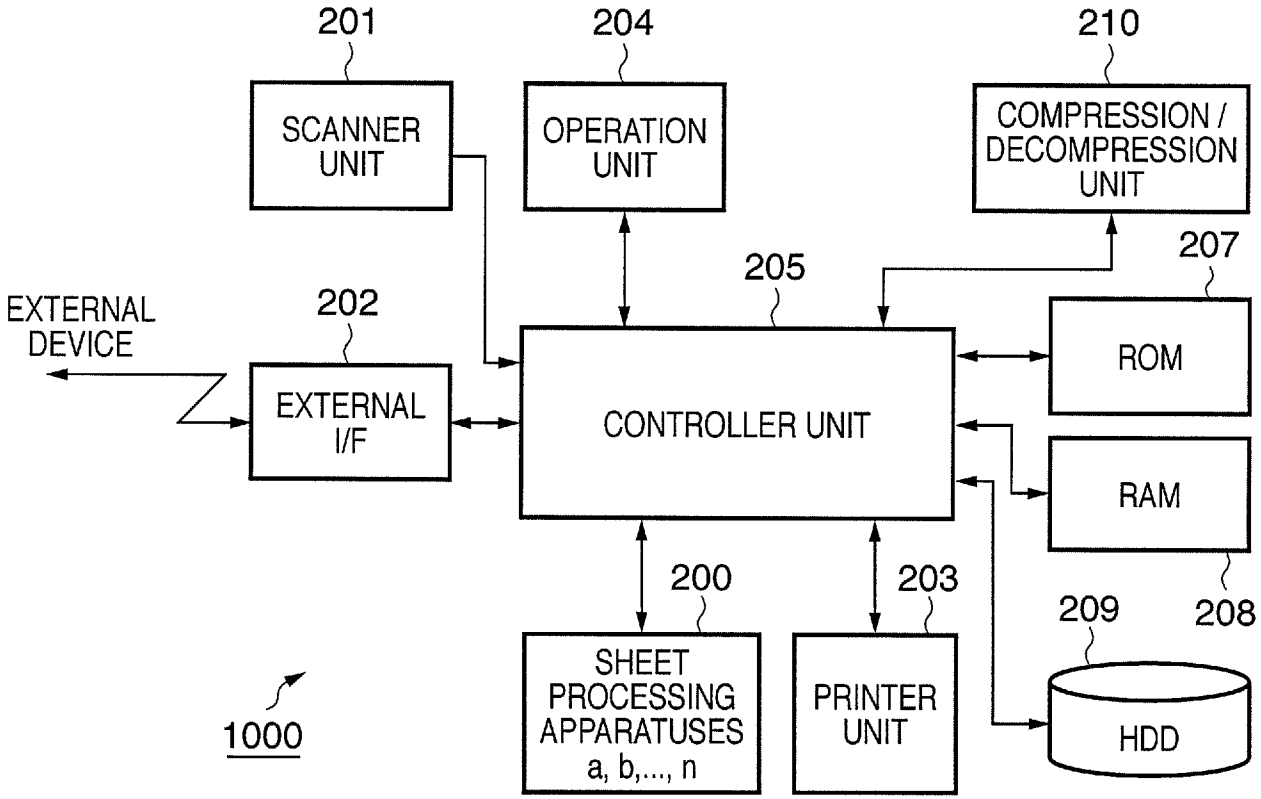
FIG. 2 is a block diagram for explaining a configuration of the printing system 1000 to be controlled.

The printing apparatus 100 incorporates units shown in FIG. 2 in the printing system 1000 except for the sheet processing apparatus 200. An arbitrary number of sheet processing apparatuses 200 are connectable to the printing apparatus 100.

The printing system 1000 is configured so that the sheet processing apparatus 200 connected to the printing apparatus 100 can execute sheet processing for sheets printed by the printing apparatus 100. It is also possible to form the printing system 1000 from only the printing apparatus 100 without connecting the sheet processing apparatus 200. The sheet processing apparatus 200 can communicate with the printing apparatus 100, and execute sheet processing (to be described later) upon receiving an instruction from the printing apparatus 100.

In the printing apparatus 100, a scanner unit 201 scans an image on a document, converts the image into image data, and transfers the image data to another unit. An external I/F 202 exchanges data with other apparatuses connected to the network 101. A printer unit 203 forms an image based on input image data, and prints it on a sheet. An operation unit 204 has a hard key input unit and touch panel, from which instructions from the user are accepted. The operation unit 204 provides various displays on its touch panel.

A control (controller) unit 205 comprehensively controls the processes and operations of various units in the printing system 1000. The control unit 205 also controls the operation of the printing apparatus 100 and that of the sheet processing apparatus 200 connected to the printing apparatus 100. A ROM 207 stores various programs to be executed by the control unit 205. For example, the ROM 207 stores programs to execute various processes of flowcharts to be described later, and display control programs to display various setup images to be described later. The ROM 207 further stores a program to cause the control unit 205 to interpret PDL (Page Description Language) code data received from the PC 103, PC 104, or the like and rasterize the PDL code data into raster image data. In addition, the ROM 207 stores a boot sequence, font information, and the like.

A RAM 208 stores image data sent from the scanner unit 201 and external I/F 202, various programs stored in the ROM 207, and setting information. The RAM 208 also stores information on the sheet processing apparatus 200 (e.g., information on the number of (0 to n) sheet processing apparatuses 200 connected to the printing apparatus 100, information on the function of each sheet processing apparatus, or the connection order of the sheet processing apparatuses).

An HDD (Hard Disk Drive) 209 includes a hard disk, and a drive unit which reads/writes data from/to the hard disk. The HDD 209 is a large-capacity storage device which stores image data input from the scanner unit 201 and external I/F 202 and compressed by a compression/decompression unit 210. The control unit 205 instructs the printer unit 203 to print image data stored in the HDD 209 based on an instruction from the user. The control unit 205 transmits image data stored in the HDD 209 to an external apparatus such as the PC 103 via the external I/F 202 based on an instruction from the user.

The compression/decompression unit 210 compresses/decompresses image data and the like stored in the RAM 208 and HDD 209 in accordance with various compression schemes such as JBIG and JPEG.

Figure 3:
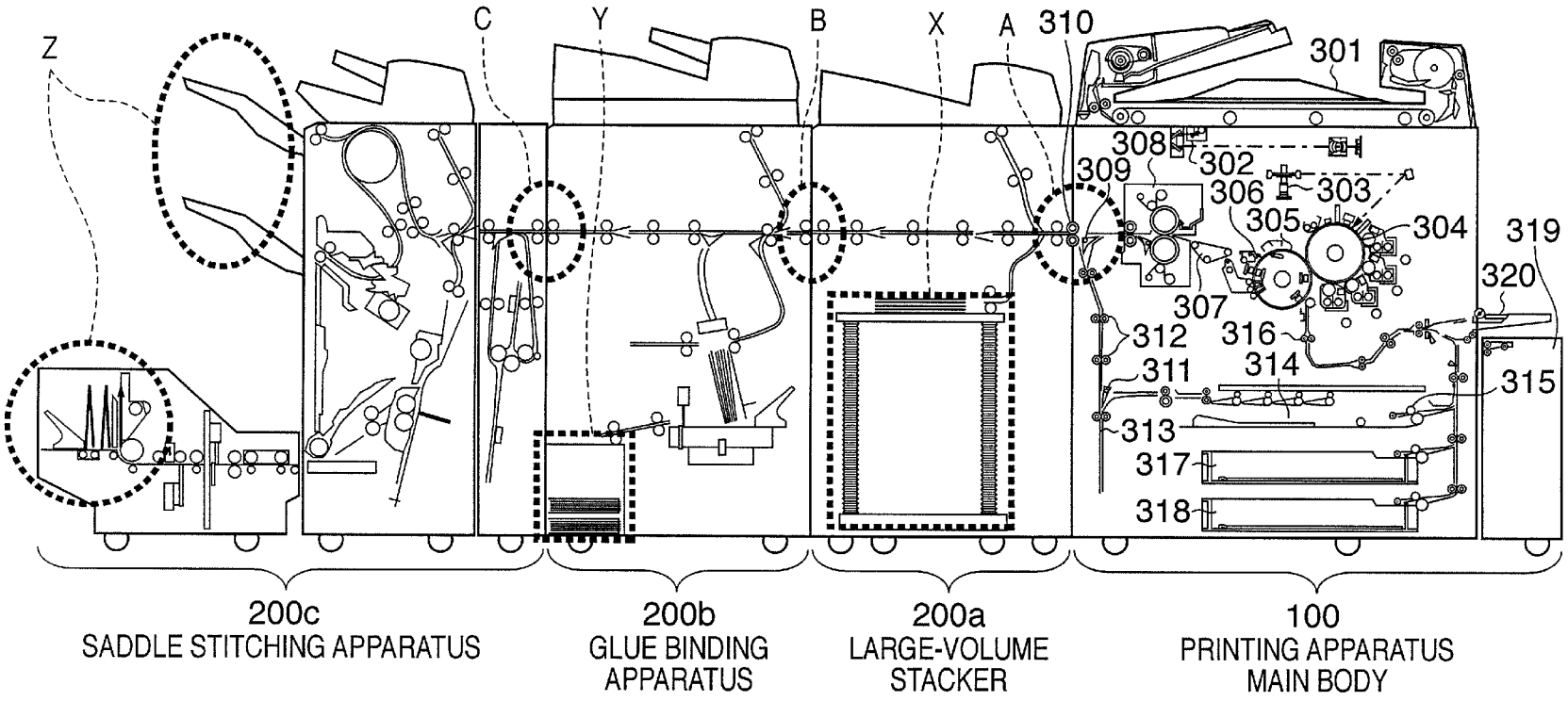
FIG. 3 is a side sectional view showing an internal configuration of the printing system 1000.

The configuration of the printing system 1000 will be explained with reference to FIG. 3. FIG. 3 is a side sectional view showing an internal configuration of the printing system 1000. The printing system 1000 is made up of the printing apparatus 100 and the sheet processing apparatus 200 connected to it.

The structure of the printing apparatus 100 will be explained first. An auto document feeder (ADF) 301 separates a document bundle on the support surface of the document tray sequentially in the order of pages from the first document sheet, and feeds each document sheet to the glass document table in order to scan the document sheet by a scanner 302.

The scanner 302 scans the image of the document sheet fed onto the glass document table, and converts the image into image data by a CCD. A rotary polygon mirror 303 receives a light ray (e.g., a laser beam) modulated in accordance with the image data, and irradiates a photosensitive drum 304 with the light ray as a reflected scan beam via a reflecting mirror. A latent image formed by the laser beam on the photosensitive drum 304 is developed with toner, and the toner image is transferred onto a sheet material on a transfer drum 305. A series of image forming processes is executed sequentially with yellow (Y), magenta (M), cyan (C), and black (K) toners, forming a full-color image. After four image forming processes, the sheet material bearing the full-color image is separated by a separation gripper 306 from the transfer drum 305, and conveyed to a fixing unit 308 by a pre-fixing conveyor 307. The fixing unit 308 has a combination of rollers and belts, and incorporates a heat source such as a halogen heater. The fixing unit 308 fuses and fixes, by heat and pressure, toner on a sheet material bearing a toner image. A delivery flapper 309 is swingable about the swing shaft, and regulates the sheet material conveyance direction. When the delivery flapper 309 swings clockwise in FIG. 3, a sheet material is conveyed straight, and discharged outside the apparatus by delivery rollers 310. The control unit 205 controls the printing apparatus 100 to execute single-sided printing according to this sequence.

To form images on the two surfaces of a sheet material, the delivery flapper 309 swings counterclockwise in FIG. 3, and the course of the sheet material changes to the downward direction to supply the sheet material to the double-sided conveyance section. The double-sided conveyance section has a reverse flapper 311, reverse rollers 312, a reverse guide 313, and a double-sided tray 314. The reverse flapper 311 swings about the swing shaft, and regulates the sheet material conveyance direction. To process a double-sided print job, the control unit 205 controls to swing the reverse flapper 311 counterclockwise in FIG. 3 to supply a sheet having the first surface printed by the printer unit 203 to the reverse guide 313 via the reverse rollers 312. While the reverse rollers 312 clamp the trailing end of the sheet material, the reverse rollers 312 temporarily stop, the reverse flapper 311 swings clockwise in FIG. 3, and the reverse rollers 312 rotate backward. The sheet is switched back to replace its trailing and leading ends, and then the sheet is guided to the double-sided tray 314. The double-sided tray 314 temporarily supports the sheet material, and a refeed roller 315 supplies the sheet material again to registration rollers 316. At this time, the sheet material is sent while a surface opposite to the first surface in the transfer process faces the photosensitive drum. The second image is formed on the second surface of the sheet by the same process as that described above. After the images are formed on the two surfaces of the sheet material, the sheet undergoes the fixing process and is discharged outside from the printing apparatus main body via the delivery rollers 310. The control unit 205 controls the printing apparatus 100 to execute double-sided printing according to this sequence.

The printing apparatus 100 comprises a paper feed section which stores sheets necessary for print processing. The paper feed section has paper feed cassettes 317 and 318 (each capable of storing, e.g., 500 sheets), a paper feed deck 319 (capable of storing, e.g., 5,000 sheets), and a manual feed tray 320. The paper feed cassettes 317 and 318 and the paper deck 319 allow setting sheets of different sizes and materials discriminatively in the respective paper feed units. The manual feed tray 320 also allows setting various sheets including a special sheet such as an OHP sheet. The paper feed cassettes 317 and 318, the paper deck 319, and the manual feed tray 320 respectively have paper feed rollers, which successively feed sheets one by one.

The sheet processing apparatuses 200 will be explained. Note that an arbitrary number of (maximum of five) sheet processing apparatuses 200 of arbitrary types are connectable as long as they can convey a sheet from an upstream apparatus to a downstream apparatus via the sheet feeding path. For example, a large-volume stacker 200*a*, glue binding apparatus 200*b*, and saddle stitching apparatus 200*c* are connected in the order named closer from the printing apparatus 100, and selectively available in the printing system 1000. Each sheet processing apparatus 200 has a sheet discharge portion, and the user can take out a processed sheet from the sheet discharge portion of the sheet processing apparatus.

The control unit 205 accepts, together with a print execution request via the operation unit 204, a request to execute sheet processing of a type desired by the user among sheet processing candidates of types executable by the sheet processing apparatuses 200 connected to the printing apparatus 100. Upon accepting a print execution request for a target job from the user via the operation unit 204, the control unit 205 causes the printer unit 203 to execute print processing necessary for the job. The control unit 205 controls to convey printed sheets of the job via the sheet feeding path to a sheet processing apparatus capable of executing sheet processing desired by the user. Then, the control unit 205 causes the sheet processing apparatus to execute the sheet processing.

Assume that a target job whose print execution request is accepted from the user requires large-volume stacking processing by the large-volume stacker 200*a* when the printing system 1000 has a system configuration shown in FIG. 3. This job is called a "stacker job".

When processing the stacker job in the system configuration of FIG. 3, the control unit 205 controls to convey sheets of the job printed by the printing apparatus 100 into the large-volume stacker via point A in FIG. 3. Then, the control unit 205 causes the large-volume stacker 200*a* to stack the sheets of the job. The control unit 205 causes the large-volume stacker 200*a* to hold the printed materials of the job stacked in the large-volume stacker 200*a* at delivery destination X inside the large-volume stacker 200*a* without conveying them to another apparatus (e.g., a succeeding apparatus).

The user can directly take out, from delivery destination X, the printed materials of the stacker job held at delivery destination X in FIG. 3. This can omit a series of apparatus operations and user operations to convey sheets to the most downstream delivery destination Z in the sheet conveyance direction in FIG. 3 and take out the printed materials of the stacker job from delivery destination Z.

Assume that a target job whose print execution request is accepted from the user requires sheet processing (e.g., glue binding of case binding or pad binding) by the glue binding apparatus 200*b* in the system configuration of FIG. 3. This job is called a "glue binding job".

When processing the glue binding job in the system configuration of FIG. 3, the control unit 205 controls to convey sheets printed by the printing apparatus 100 into the glue binding apparatus 200*b* via points A and B in FIG. 3. Then, the control unit 205 causes the glue binding apparatus 200*b* to bind the sheets of the job with glue. The control unit 205 causes the glue binding apparatus 200*b* to hold the printed materials of the job glue-bound by the glue binding apparatus 200*b* at delivery destination Y inside the glue binding apparatus 200*b* without conveying them to another apparatus (e.g., a succeeding apparatus).

Assume that a target job whose print execution request is accepted from the user requires sheet processing by the saddle stitching apparatus 200*c* in the system configuration of FIG. 3. The sheet processing by the saddle stitching apparatus 200*c* includes, for example, saddle stitching, punching, cutting, shift delivery, and folding. This job is called a "saddle stitching job".

When processing the saddle stitching job by the system configuration in FIG. 3, the control unit 205 controls to convey sheets of the job printed by the printing apparatus 100 into the saddle stitching apparatus 200*c* via points A, B, and C. Then, the control unit 205 causes the saddle stitching apparatus 200*c* to process the sheets of the job. The control unit 205 causes the saddle stitching apparatus 200*c* to hold the printed materials of the saddle stitching job at delivery destination Z in the saddle stitching apparatus 200*c*.

Delivery destination Z has a plurality of delivery destination candidates. This is because the saddle stitching apparatus can execute a plurality of types of sheet processes and the delivery destination changes in each sheet processing.

As described with reference to FIGS. 1 to 3, the printing system 1000 according to the embodiment allows connecting a plurality of sheet processing apparatuses to the printing apparatus 100. These sheet processing apparatuses can be arbitrarily combined and connected to the printing apparatus 100. The connection order of the sheet processing apparatuses can be freely changed as long as the sheet feeding paths of the sheet processing apparatuses link with each other. There is a plurality of types of sheet processing apparatus candidates connectable to the printing apparatus 100.

The internal structures of the sheet processing apparatuses connectable to the printing apparatus 100 will be explained for each type with reference to FIGS. 4 to 6.

The internal structure of the large-volume stacker will be explained with reference to the sectional view shown in FIG. 4. The large-volume stacker conveys a sheet from an upstream apparatus selectively to one of three feeding paths (escape path, stack path, and straight path).

The stack path in the large-volume stacker is a sheet feeding path for conveying sheets to the stack tray. The stack tray in FIG. 4 is a stacking unit mounted on an extensible stay. A demountable dolly supports the extensible stay from below it. With the dolly, the operator can carry sheets stacked on the stack tray.

Assume that the control unit 205 accepts a request from the user via the operation unit 204 to execute a job set to perform sheet stacking processing by the large-volume stacker. In this case, the control unit 205 conveys sheets printed by the printing apparatus 100 to the stack path of the large-volume stacker, and delivers them to the stack tray via the stack path.

Figure 4:
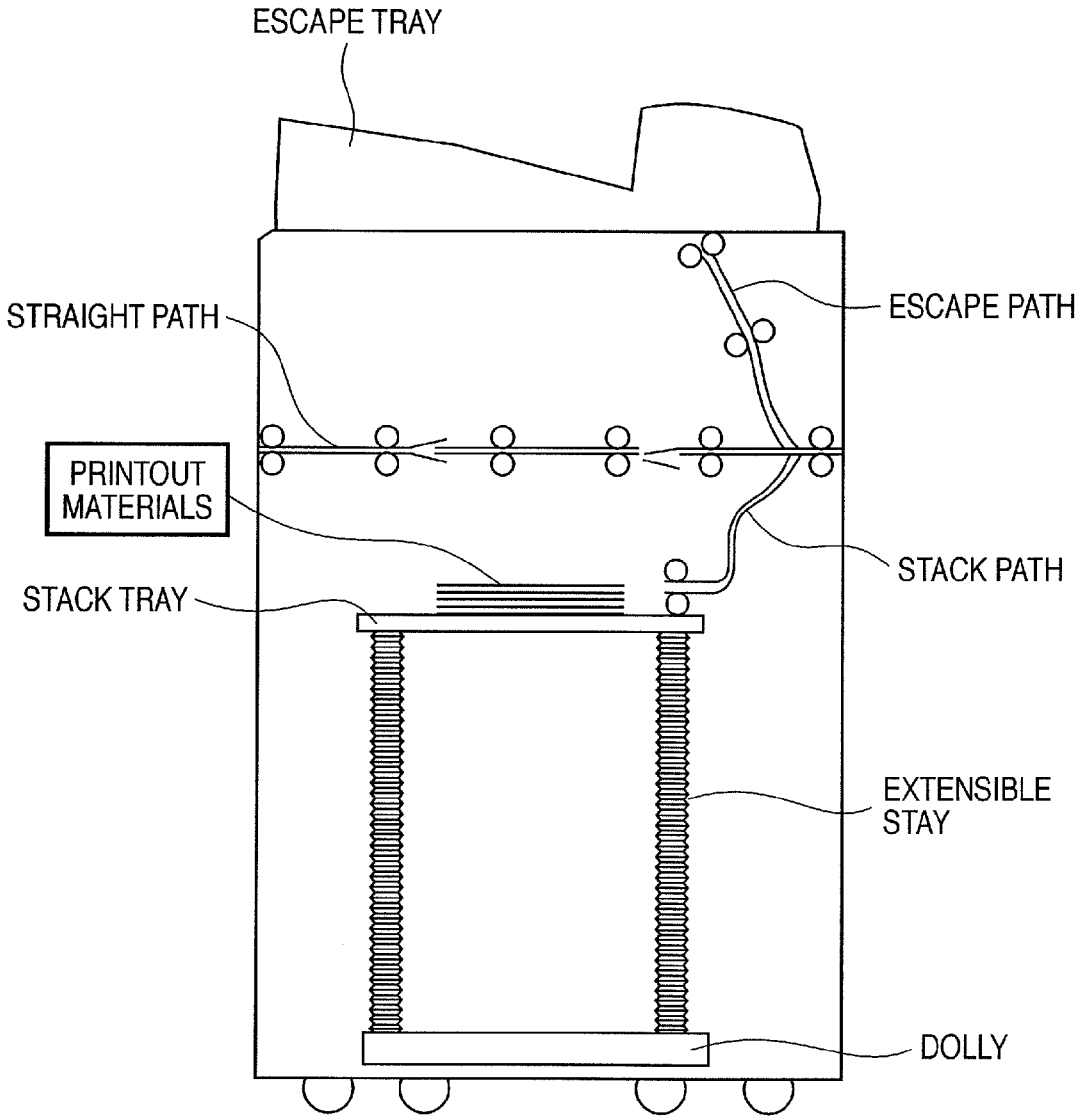
FIG. 4 is a side sectional view showing an internal structure of a large-volume stacker.

The straight path of the large-volume stacker shown in FIG. 4 is a sheet feeding path for conveying, to a succeeding apparatus, sheets of a job requiring no sheet stacking processing using the stack tray of the large-volume stacker.

The escape path is a sheet feeding path for discharging sheets to the escape tray (also called a sample tray). The escape path is used to output sheets without stacking them. For example, when confirming outputs (proof print), printed materials are conveyed to the escape path and can be taken out from the escape tray.

A plurality of sheet sensors necessary to detect the sheet conveyance status and paper jams is arranged on the sheet feeding path in the large-volume stacker.

The large-volume stacker comprises a CPU (not shown), and the CPU notifies the control unit 205 of sheet detection information from each sensor via a signal line for data communication. Based on the information from the large-volume stacker, the control unit 205 grasps the sheet conveyance status and paper jams in the large-volume stacker. When another sheet processing apparatus is connected between the large-volume stacker and the printing apparatus 100, the CPU (not shown) of the sheet processing apparatus notifies the control unit 205 of sensor information of the large-volume stacker.

The internal structure of the glue binding apparatus will be explained with reference to the sectional view shown in FIG. 5. The glue binding apparatus conveys a sheet from an upstream apparatus selectively to one of three feeding paths (cover path, main body path, and straight path).

The glue binding apparatus also has an inserter path. The inserter path is a sheet feeding path for conveying a sheet on the insertion tray to the cover path.

Figure 5:
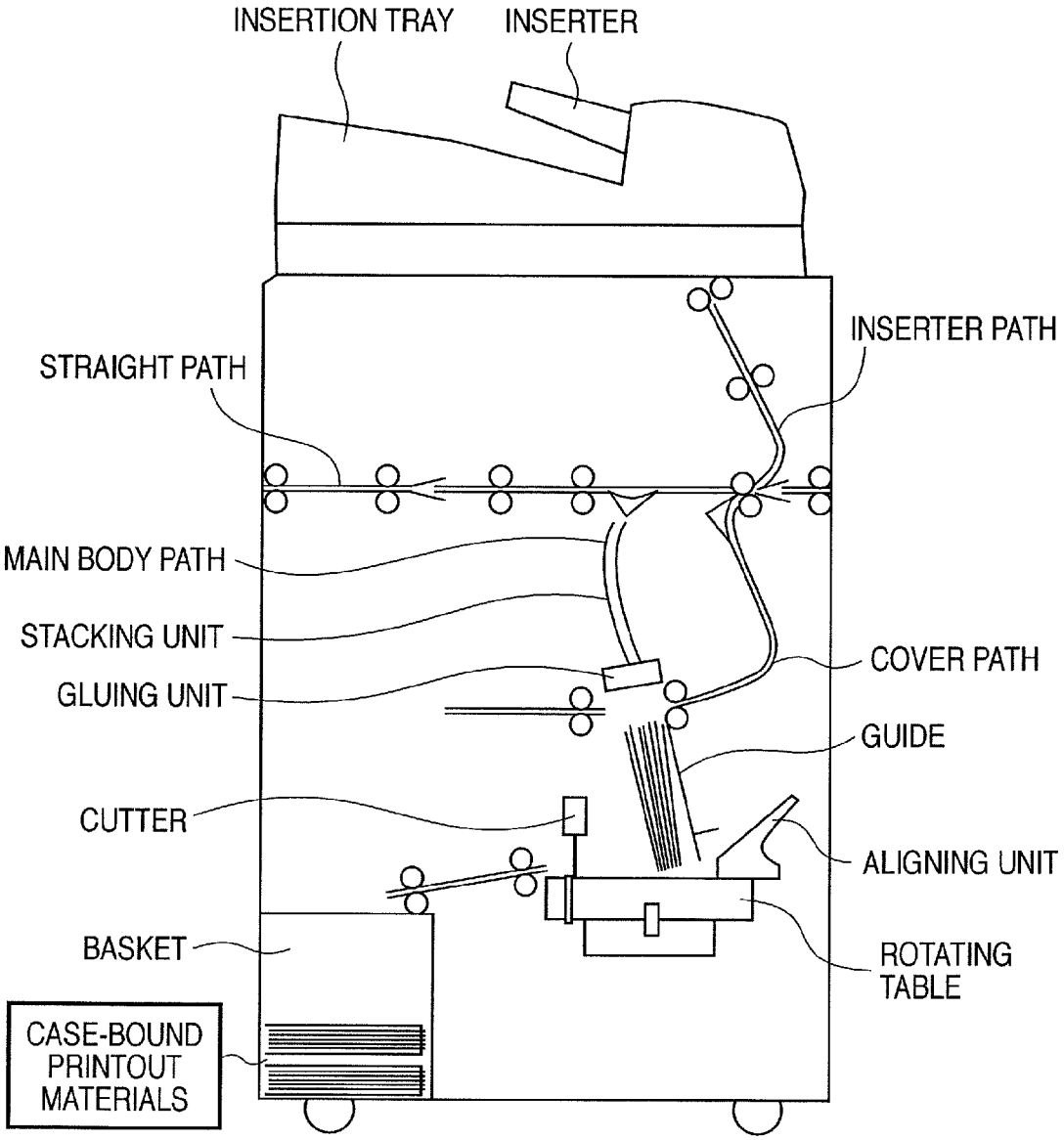
FIG. 5 is a side sectional view showing an internal structure of a glue binding apparatus.

The straight path of the glue binding apparatus in FIG. 5 is a sheet feeding path for conveying, to a succeeding apparatus, sheets of a job requiring no glue binding by the glue binding apparatus.

The main body path and cover path of the glue binding apparatus shown in FIG. 5 are sheet feeding paths for conveying sheets necessary to create case-bound printed materials.

For example, when creating case-bound printed materials using the glue binding apparatus, the control unit 205 causes the printer unit 203 to print image data of the body on sheets serving as the body of the case-bound printed materials. Case-bound printed materials of one booklet are created by wrapping a bundle of body sheets for one booklet with one cover. The body sheet bundle in case binding will be called a "main body".

The control unit 205 controls to convey sheets printed by the printing apparatus 100 to the main body path shown in FIG. 5. In case binding, the control unit 205 causes the glue binding apparatus to wrap the main body printed by the printing apparatus 100 with a cover sheet conveyed via the cover path.

For example, the control unit 205 causes the glue binding apparatus to sequentially stack main body sheets conveyed from an upstream apparatus on the stacking unit via the main body path in FIG. 5. After stacking sheets bearing body data on the stacking unit by the number of sheets of one booklet, the control unit 205 controls to convey one cover sheet necessary for the job via the cover path. The control unit 205 controls a gluing unit in FIG. 5 to glue the spine of the sheet bundle of one set corresponding to the main body. Then, the control unit 205 controls the gluing unit to bond the spine of the main body to the center of the cover. In bonding the main body to the cover, the main body is conveyed and pushed down in the apparatus. As a result, the cover is folded to wrap the main body with one cover. The sheet bundle of one set is stacked on a rotating table in FIG. 5 along the guide.

After the sheet bundle of one set is set on the rotating table in FIG. 5, the control unit 205 causes a cutter in FIG. 5 to cut the sheet bundle. At this time, the cutter can execute three-side cutting processing to cut three edges of the sheet bundle of one set other than an edge serving as the spine. The control unit 205 uses an aligning unit to push the sheet bundle having undergone three-side cutting processing toward a basket, putting the sheet bundle into the basket in FIG. 5.

The internal structure of the saddle stitching apparatus will be explained with reference to the sectional view shown in FIG. 6. The saddle stitching apparatus comprises various units for selectively executing stapling, cutting, punching, folding, shift delivery, saddle stitching, and the like for sheets from the printing apparatus 100. The saddle stitching apparatus does not have a straight path for conveying sheets to a succeeding apparatus. For this reason, the saddle stitching apparatus is connected last, as shown in FIG. 3, when connecting a plurality of sheet processing apparatuses to the printing apparatus 100.

Figure 6:
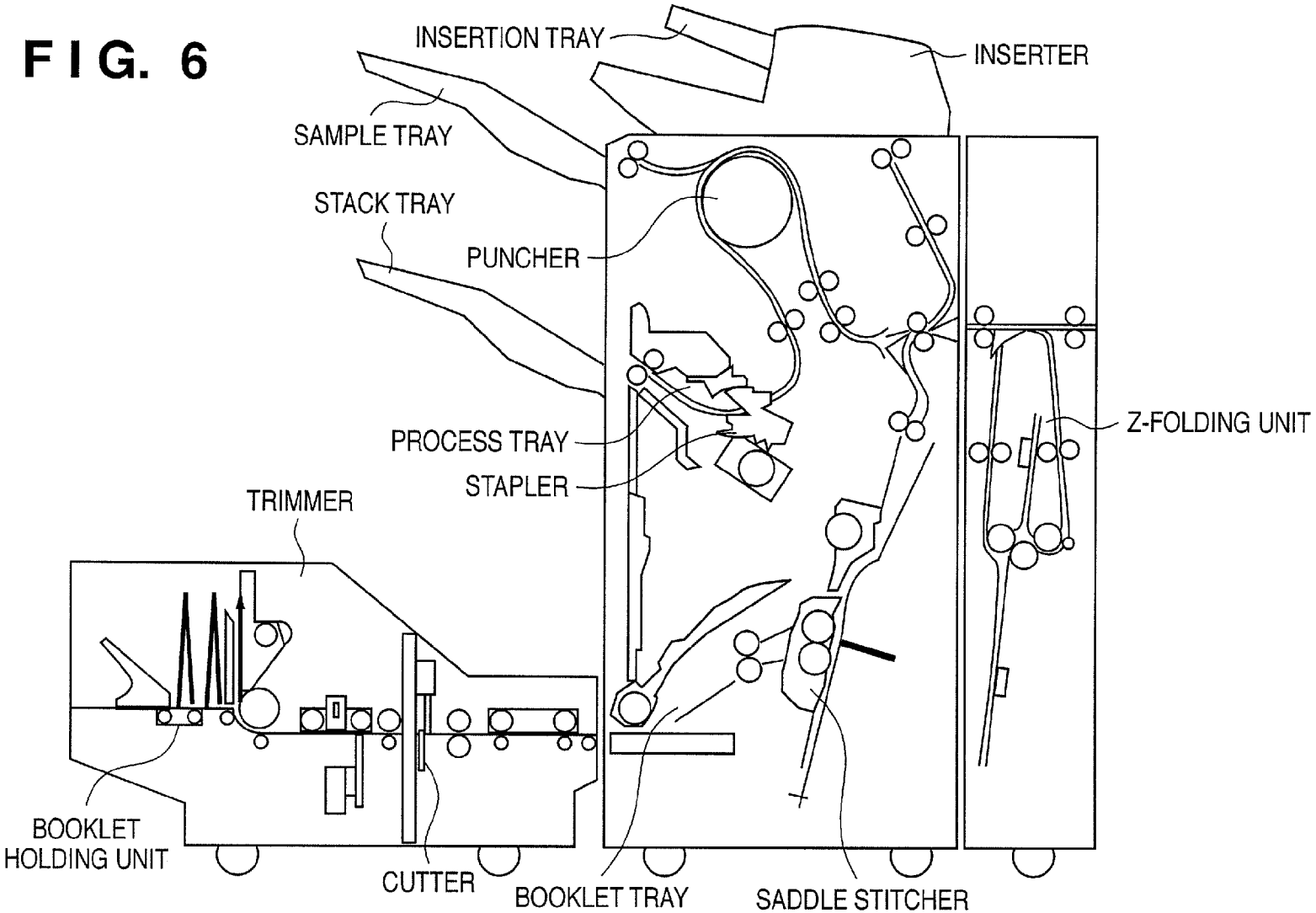
FIG. 6 is a side sectional view showing an internal structure of a saddle stitching apparatus.

As shown in FIG. 6, the saddle stitching apparatus has a sample tray and stack tray outside the apparatus, and a booklet tray inside the apparatus.

Upon accepting an instruction to staple sheets by the saddle stitching apparatus, the control unit 205 causes the saddle stitching apparatus to sequentially stack sheets printed by the printing apparatus 100 on the process tray inside the saddle stitching apparatus. After stacking sheets of one bundle on the process tray, the control unit 205 causes a stapler to staple them. The control unit 205 causes the saddle stitching apparatus to discharge the stapled sheet bundle from the process tray to the stack tray in FIG. 6.

When executing a job for which the control unit 205 accepts an instruction to Z-fold sheets by the saddle stitching apparatus, the control unit 205 causes a Z-folding unit to Z-fold sheets printed by the printing apparatus 100. The control unit 205 controls to make the folded sheets pass through the saddle stitching apparatus and deliver them to a discharge tray such as the stack tray or sample tray.

Upon accepting an instruction to perform punching by the saddle stitching apparatus, the control unit 205 causes a puncher to punch sheets printed by the printing apparatus 100. The control unit 205 controls to make the punched sheets pass through the saddle stitching apparatus and deliver them onto a discharge tray such as the stack tray or sample tray.

When executing a job for which the control unit 205 accepts an instruction to saddle-stitch sheets by the saddle stitching apparatus, the control unit 205 causes a saddle stitcher to stitch a bundle of sheets by one set at two center portions. The control unit 205 causes the saddle stitcher to clamp the sheet bundle at the center by rollers and fold the sheets into two at the center, thereby creating a booklet such as a brochure. The sheet bundle saddle-stitched by the saddle stitcher is conveyed onto the booklet tray.

Upon accepting a cutting instruction for a job for which the control unit 205 accepts an instruction to saddle-stitch sheets, the control unit 205 controls to convey a saddle-stitched sheet bundle from the booklet tray to a trimmer. The control unit 205 causes a cutter to cut the sheet bundle conveyed to the trimmer, and a booklet holding unit to hold the sheet bundle. The saddle stitching apparatus in FIG. 6 can also cut three edges of a saddle-stitched sheet bundle.

When the saddle stitching apparatus does not have any trimmer, the operator can take out a sheet bundle bound by the saddle stitcher from the booklet tray.

The saddle stitching apparatus can also attach a sheet (e.g., a cover sheet printed in advance) set on the insertion tray in FIG. 6 to a sheet printed by the printing apparatus 100 and conveyed from it.

Figure 7:
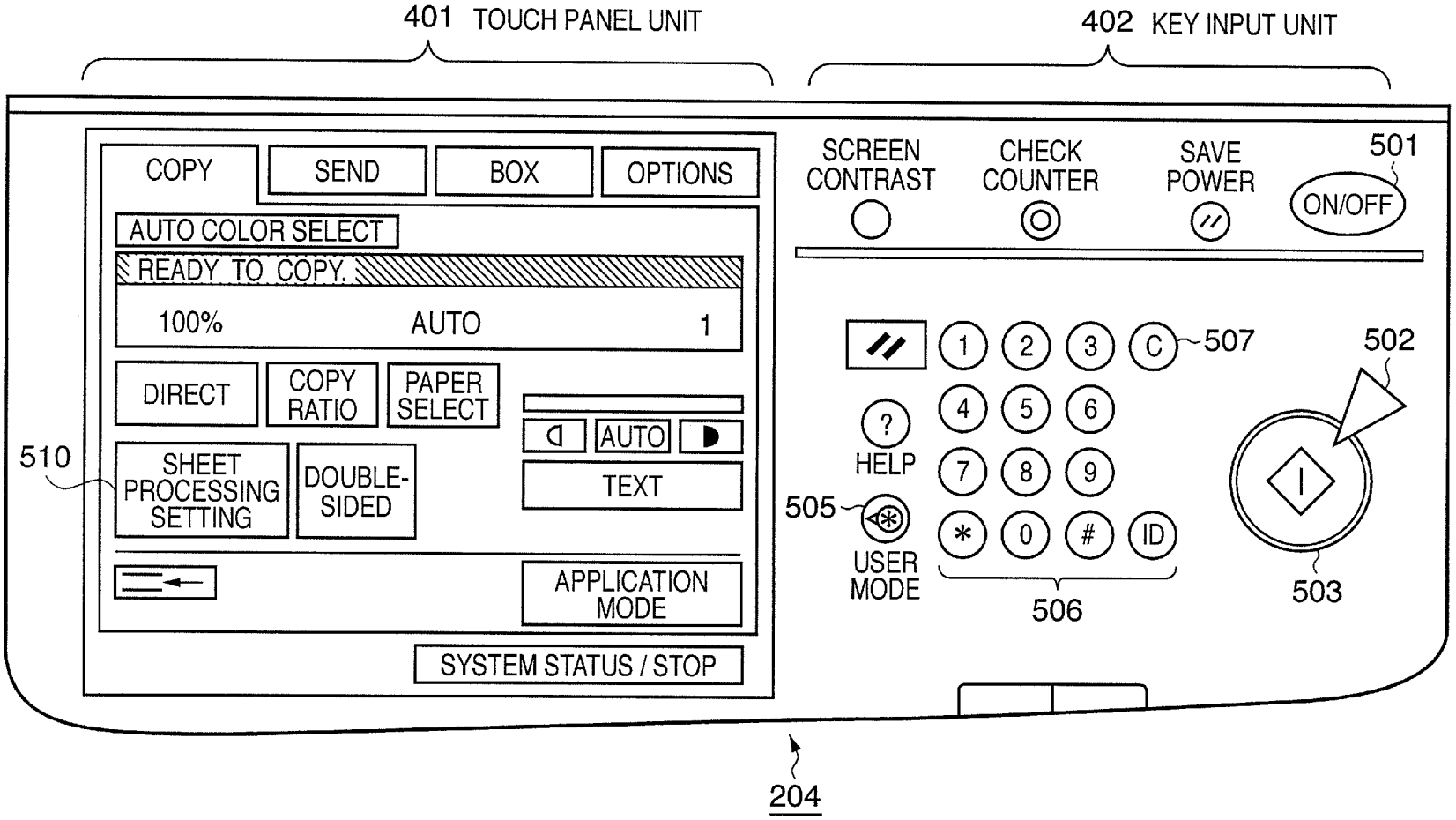
FIG. 7 is a view showing an arrangement of an operation unit 204.

The arrangement of the operation unit 204 will be described with reference to FIG. 7. The operation unit 204 comprises a touch panel unit 401 and key input unit 402. The touch panel unit 401 is formed from an LCD (Liquid Crystal Display) and a transparent electrode adhered onto the LCD, and displays various setup windows for accepting an instruction from the user. The touch panel unit 401 has both a function of displaying various windows and an instruction input function of accepting an instruction from the user. The key input unit 402 comprises a power key 501, start key 503, stop key 502, user mode key 505, and numerical keypad 506. The start key 503 is used to cause the printing apparatus 100 to start a copy job and send job. The numerical keypad 506 is used to set a numerical value such as the number of copies.

The control unit 205 controls the printing system 1000 to perform various processes based on user instructions accepted via various windows displayed on the touch panel unit 401 and user instructions accepted via the key input unit 402.

Figure 8:
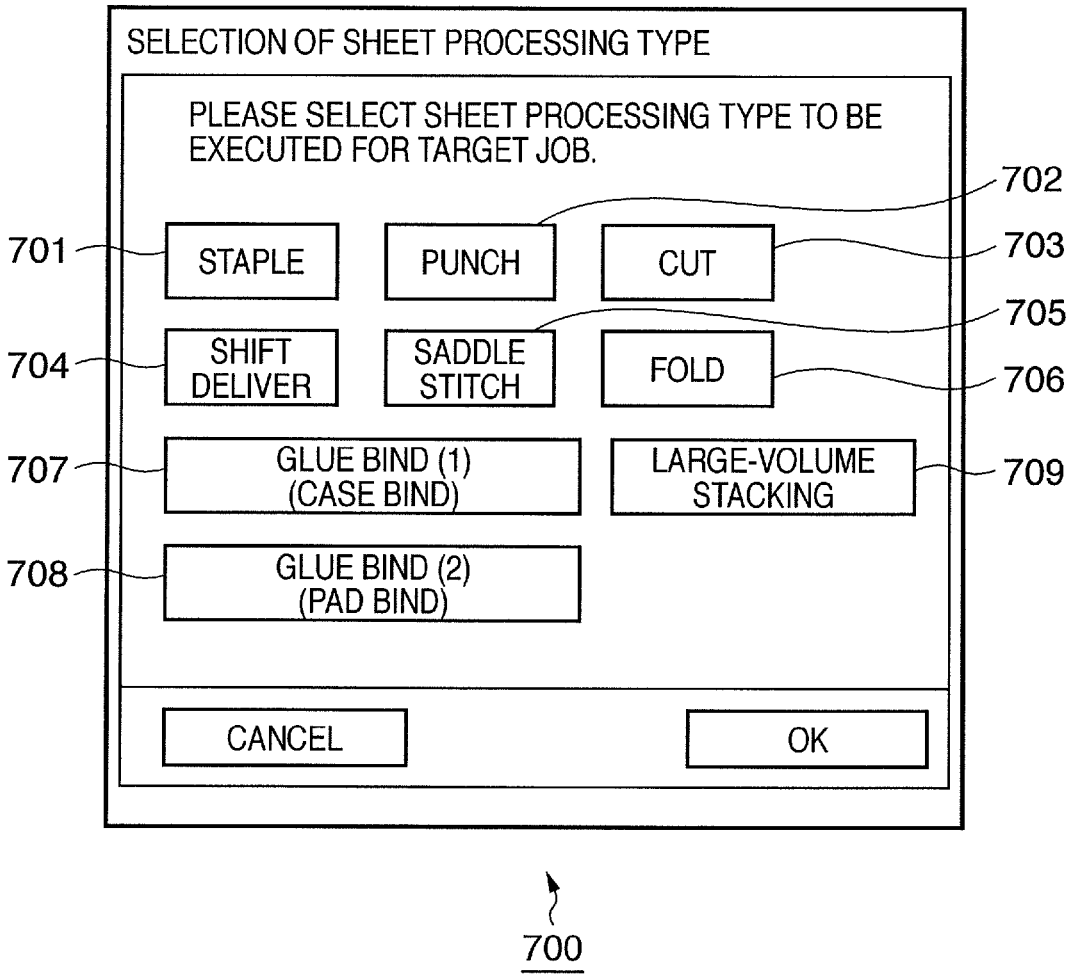
FIG. 8 is a view showing an example of a window to select a sheet processing type.

FIG. 8 shows a setup window for prompting the user to select the type of sheet processing to be executed for sheets printed by the printing apparatus 100. When the user presses a sheet processing setting key 510 in FIG. 7 displayed in the window on the touch panel unit 401, the control unit 205 causes the touch panel unit 401 to display the window in FIG. 8. This window is a setup window which allows the user to select the type of sheet processing executable by the sheet processing apparatus 200 present in the printing system 1000. For example, the user can select staple 701, punch 702, cut 703, shift delivery 704, saddle stitch 705, fold 706, glue bind (case bind) 707, glue bind (pad bind) 708, and large-volume stacking 709. The control unit 205 accepts, from the user via this setup window, settings of sheet processing to be executed for a target job, and causes the sheet processing apparatus 200 to execute the sheet processing according to the settings.

Figure 9:
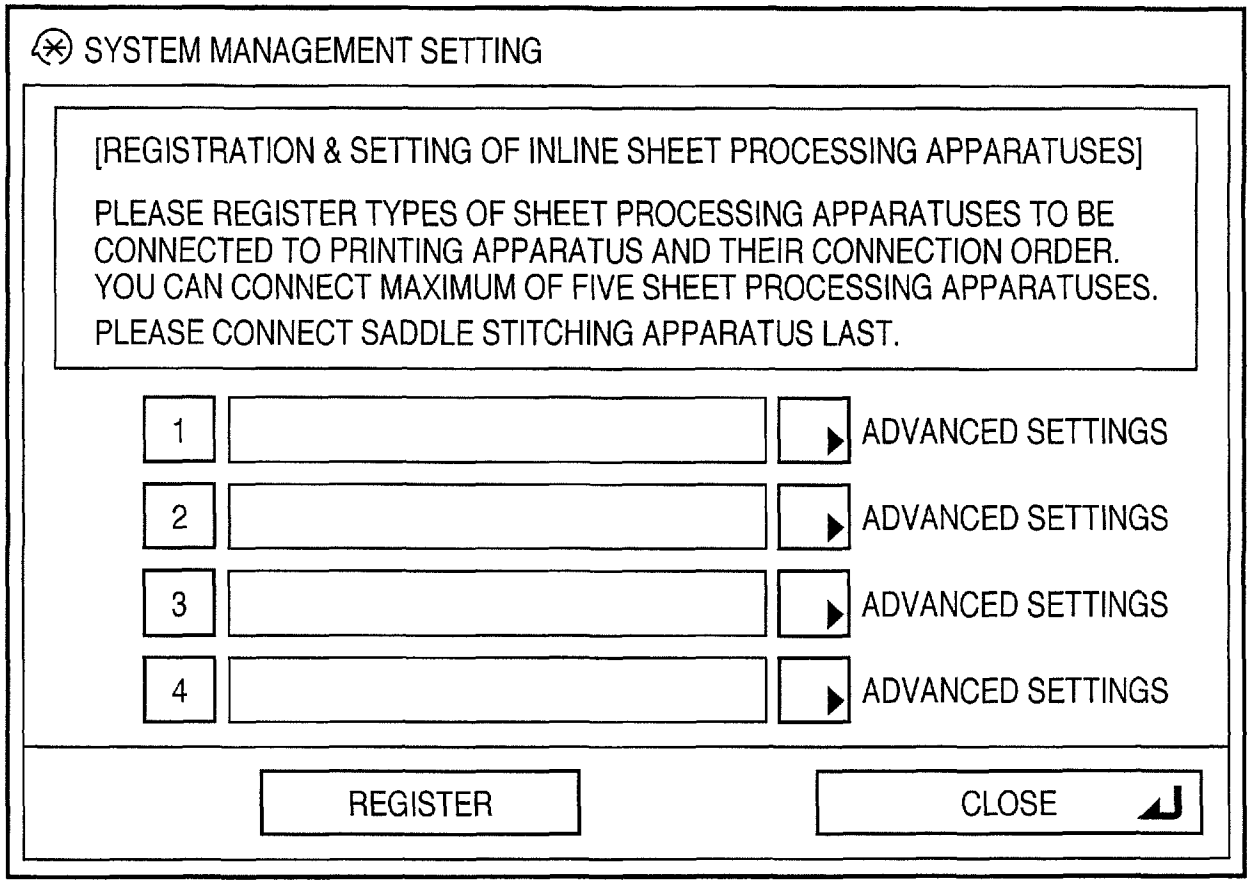
FIG. 9 is a view showing an example of a window to register and set a sheet processing apparatus.

A window shown in FIG. 9 is a setup window which allows the user to register information for specifying the number, types, and connection order of sheet processing apparatuses when the sheet processing apparatuses 200 are connected to the printing apparatus 100. When the user presses the user mode key 505, the control unit 205 causes the touch panel unit 401 to display the window shown in FIG. 9.

For example, when the printing system 1000 has the system configuration as shown in FIG. 3, the user sets, in the window of FIG. 9, registration information that three sheet processing apparatuses, that is, the large-volume stacker, glue binding apparatus, and saddle stitching apparatus are connected to the printing apparatus 100 sequentially from the large-volume stacker. The control unit 205 causes the RAM 208 to hold, as system configuration information, the information on the sheet processing apparatuses 200 that is set by the user via the window in FIG. 9. The control unit 205 properly reads out and refers to the system configuration information. From the system configuration information, the control unit 205 confirms the number and connection order of sheet processing apparatuses connected to the printing apparatus 100, and sheet processing types executable by the sheet processing apparatuses.

When the user makes a setting in the window of FIG. 9 to connect the saddle stitching apparatus having no straight path between sheet processing apparatuses, the control unit 205 causes the touch panel unit 401 to present an error display in order to invalidate the setting. Further, as shown in FIG. 9, the control unit 205 causes the touch panel unit 401 to display guidance information and notify the user of cancellation of this setting and connection of the saddle stitching apparatus last.

The embodiment exemplifies the operation unit 204 of the printing apparatus 100 as an example of a user interface unit applied to the printing system 1000, but another user interface unit is also available. For example, the printing system 1000 is configured to be able to execute processing based on an instruction from the user interface unit of an external apparatus such as the PC 103 or PC 104.

Figure 10:
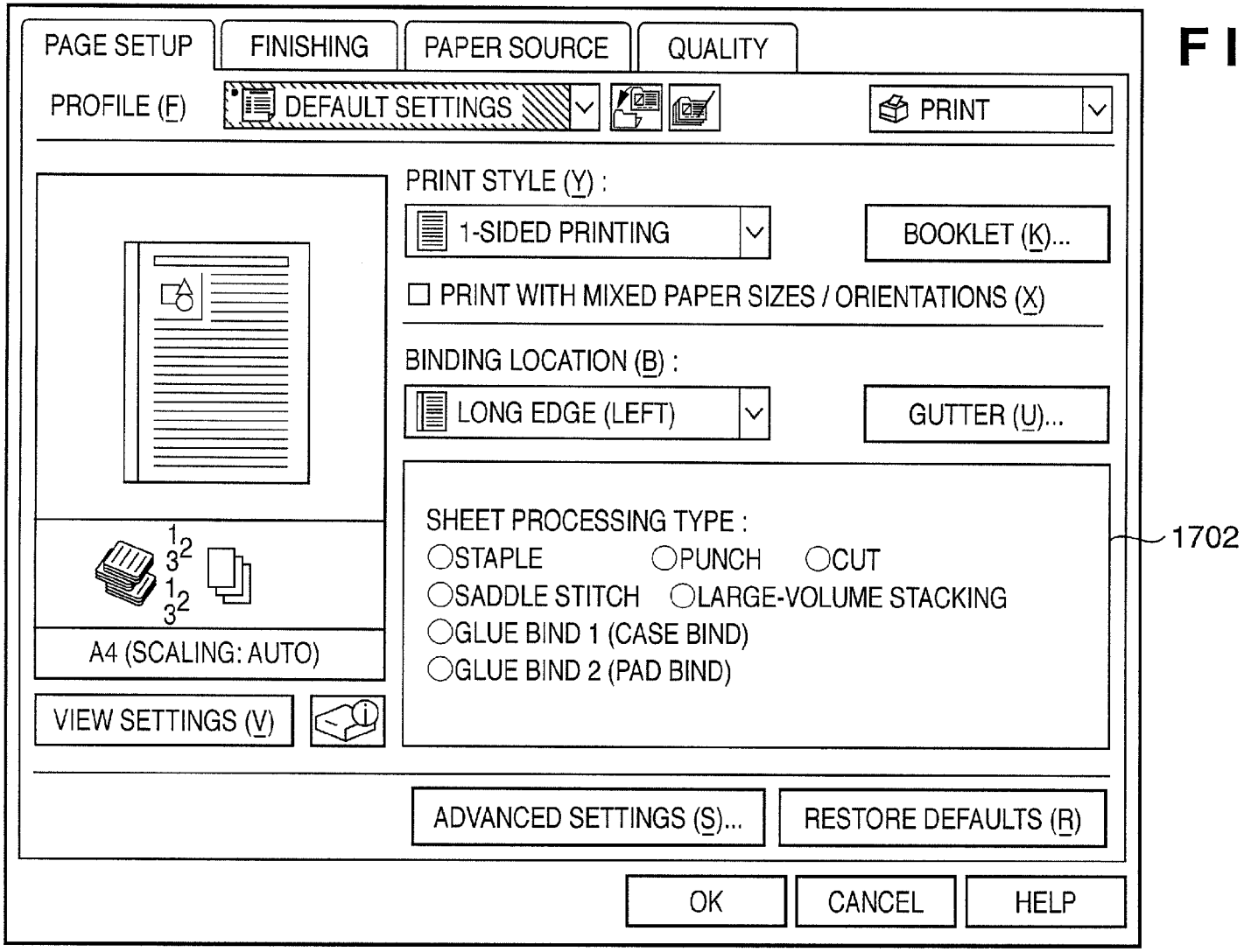
FIG. 10 is a view showing an example of a window to select a sheet processing type on the display unit of a computer.

When the external apparatus remote-controls the printing system 1000, the display unit of the external apparatus displays a setup window relevant to the printing system 1000, as shown in FIG. 10. This will be exemplified using the PC 104. FIG. 10 shows an example of a window on the display of the PC 104.

Upon accepting a print request from the user, the CPU of the PC 104 causes the display to present the window as shown in FIG. 10. The CPU accepts the settings of print processing conditions from the user of the PC 104 via the window. For example, the CPU of the PC 104 accepts, from the user via a setting field 1702, the type of sheet processing to be executed by the sheet processing apparatus 200 for a print job for which the PC 104 issues a print execution request. Upon accepting the print execution request in response to the pressing of an OK key shown in FIG. 10, the CPU of the PC 104 associates the print processing conditions accepted via the window with image data to be printed. The CPU of the PC 104 controls to transmit the resultant data as one job to the printing system 1000 via the network 101.

In the printing system 1000, upon accepting the print execution request of the job via the external I/F 202, the control unit 205 controls the printing system 1000 to process the job from the PC 104 based on the print processing conditions from the PC 104.

As the above-described printing system 1000, a system in which a plurality of sheet processing apparatuses are connected to the printing apparatus 100 and the control unit 205 of the printing apparatus 100 controls these sheet processing apparatuses will be exemplified.

Example 1

A case where the user registers, in the setup window shown in FIG. 9, a configuration in which a large-volume stacker and saddle stitching apparatus are connected to the printing apparatus 100 will be exemplified.

Figure 11:
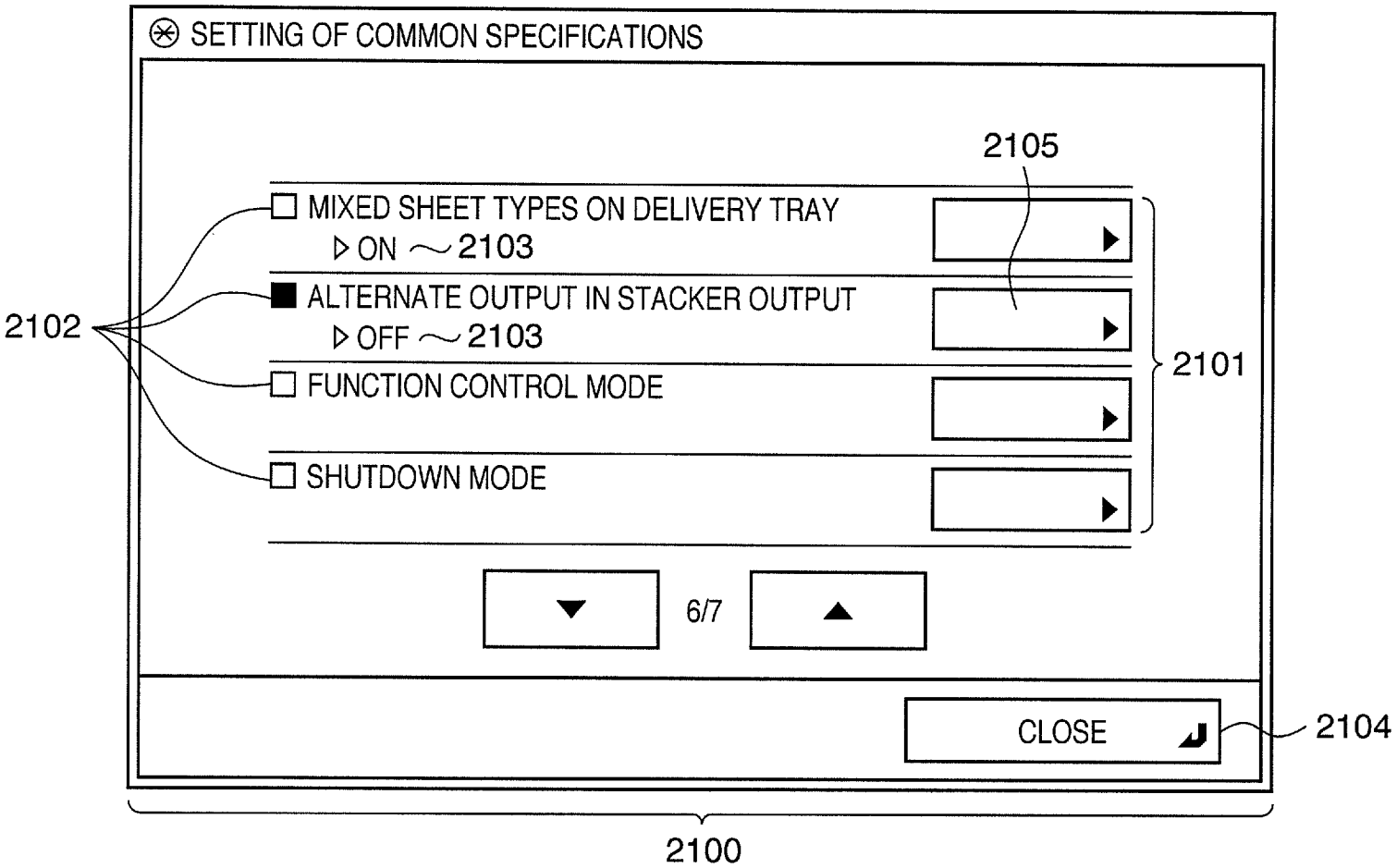
FIG. 11 is a view showing an example of a common specification setting operation window 2100.

When the user presses the user mode key 505 of the operation unit 204, regardless of whether printing of a job is in progress, the control unit 205 of the printing apparatus 100 controls the operation unit 204 to display an operation window 2100 in FIG. 11 for a configuration in which a plurality of sheet processing apparatuses are connected. In the operation window 2100, each key 2101 is used to set the operation of the printing apparatus. The operation window 2100 displays a name 2102 of each operation setting item and a setting value 2103 of each operation setting item. When the user presses a close key 2104, the control unit 205 detects that the user has pressed the close key 2104, closes the window 2100, and displays a copy operation window.

Figure 12:
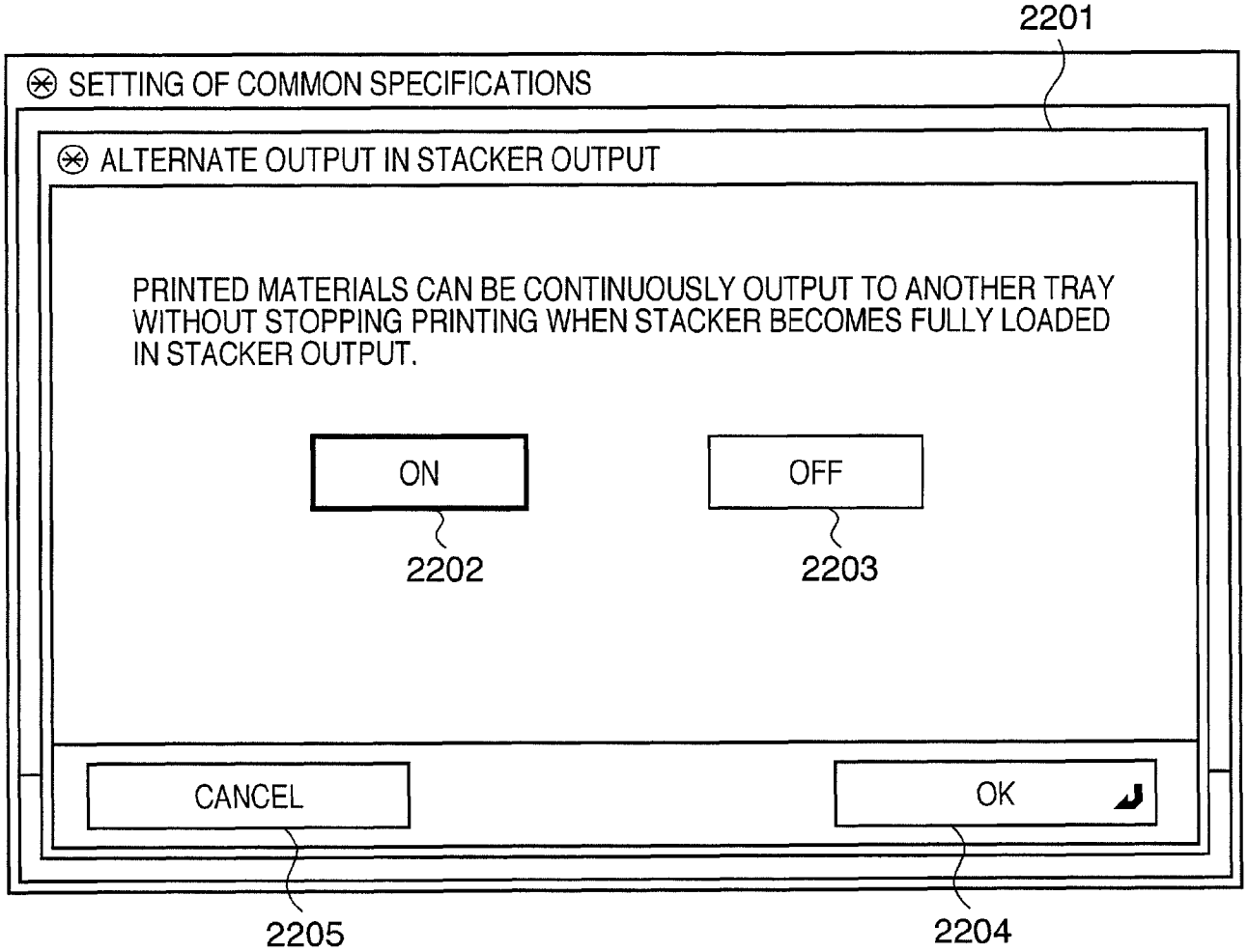
FIG. 12 is a view showing an example of an alternate output window 2201 in stacker output.

When the user presses an alternate output key 2105 for stacker output in the operation window 2100, the control unit 205 detects that the user has pressed the alternate output key 2105, and displays an alternate output window 2201 for stacker output illustrated in FIG. 12. The user can select ON 2202 or OFF 2203 in the alternate output window 2201. If the user selects the ON 2202 or OFF 2203 and presses an OK key 2204, the control unit 205 writes the selected ON or OFF setting in the RAM 208 or HDD 209, and holds whether alternate output in stacker output is ON or OFF. The control unit 205 closes the alternate output window 2201, and displays the operation window 2100. At this time, the control unit 205 displays, as the setting value 2103 of the operation setting item in the operation window 2100, the value which is written and held in the RAM 208 or HDD 209 and represents whether alternate output in stacker output is ON or OFF.

When the user presses a cancel key 2205 in the alternate output window 2201, the control unit 205 detects that the user has pressed the cancel key 2205, closes the alternate output window 2201, and displays the operation window 2100. At this time, the control unit 205 does not write any ON or OFF setting in the RAM 208 or HDD 209.

Figure 13:
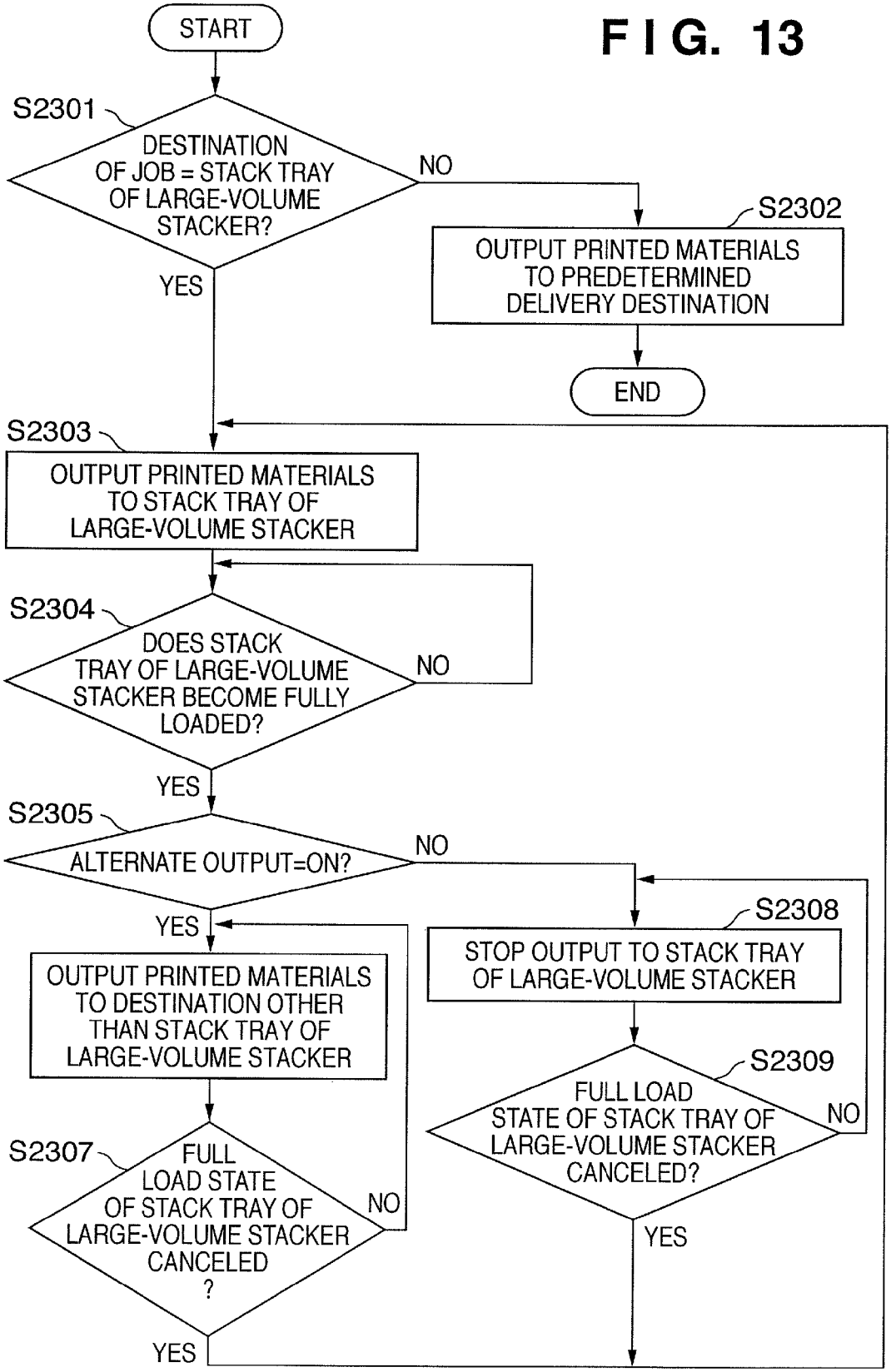
FIG. 13 is a flowchart showing control to switch the stack tray when the alternate output setting in stacker output is ON or OFF.

Control by the control unit 205 to switch the stack tray of the large-volume stacker when the alternate output setting in stacker output is ON or OFF will be explained with reference to FIG. 13.

When the user inputs a print job, the control unit 205 determines in S2301 based on destination information prepared in the RAM 208 or HDD 209 whether to output the output materials of the job to the stack tray of the large-volume stacker 200*a*. The control unit 205 may comply with an instruction contained in print job data in PDL printing, or a delivery destination instruction set in the operation window in copying when executing a job.

If the control unit 205 determines in S2301 not to output the output materials to the stack tray of the large-volume stacker 200*a*, it processes the print job, and outputs the printed materials to a destination other than the stack tray of the large-volume stacker 200*a* in S2302.

If the control unit 205 determines in S2301 to output the printed materials to the stack tray of the large-volume stacker 200*a*, it processes the print job, and outputs the printed materials to the stack tray of the large-volume stacker 200*a* in S2303. In S2304, while continuing to output the printed materials to the stack tray of the large-volume stacker 200*a*, the control unit 205 communicates with the large-volume stacker 200*a* via the external I/F 202 and monitors whether the stack tray of the large-volume stacker 200*a* becomes fully loaded with the output materials.

The control unit 205 continues the process of the print job and the output operation of printed materials in S2303 until it detects in S2304 that the stack tray of the large-volume stacker 200*a* has become fully loaded with the output materials. If the control unit 205 detects in S2304 that the stack tray of the large-volume stacker 200*a* has become fully loaded with the output materials, it advances the control to S2305.

In S2305, the control unit 205 determines, in accordance with the value held in the RAM 208 or HDD 209, whether the alternate output setting in stacker output in the operation window 2201 is ON or OFF. If the control unit 205 determines that the alternate output setting in stacker output is ON, it switches the destination of the printed materials of the print job from the stack tray of the large-volume stacker 200*a* to another destination in S2306. In this case, the control unit 205 outputs the printed materials to the escape tray of the large-volume stacker 200*a* or any tray of the saddle stitching apparatus.

In S2307, the control unit 205 checks whether the full load state of the stack tray of the large-volume stacker 200*a* has been canceled during output to the escape tray of the large-volume stacker 200*a* or any tray of the saddle stitching apparatus. If, for example, the user exchanges the dolly and the control unit 205 detects that the full load state of the stack tray of the large-volume stacker 200*a* has been canceled, the control unit 205 returns the destination of the print job again to the stack tray of the large-volume stacker 200*a* in S2303.

If the control unit 205 determines in S2305 that the alternate output setting in stacker output is OFF, it stops output of the printed materials of the print job in S2308. In S2309, the control unit 205 waits until, for example, the user exchanges the dolly and the full load state of the stack tray of the large-volume stacker 200*a* is canceled. If the control unit 205 detects that the full load state has been canceled, it starts outputting the printed materials again to the stack tray of the large-volume stacker 200*a* in S2303. The control unit 205 continues the same process till the end of the print job.

Example 2

A case where the user registers, in the setup window shown in FIG. 9, a configuration in which two large-volume stackers and a saddle stitching apparatus are connected to the printing apparatus 100 will be exemplified. In this configuration, a large-volume stacker is connected instead of the glue binding apparatus 200*b* shown in FIG. 3, and two large-volume stackers are successively cascade (tandem)-connected. The second large-volume stacker will be referred to as a "large-volume stacker 200*b*". The type and number of connected sheet processing apparatuses are not limited to this example.

Figure 14:
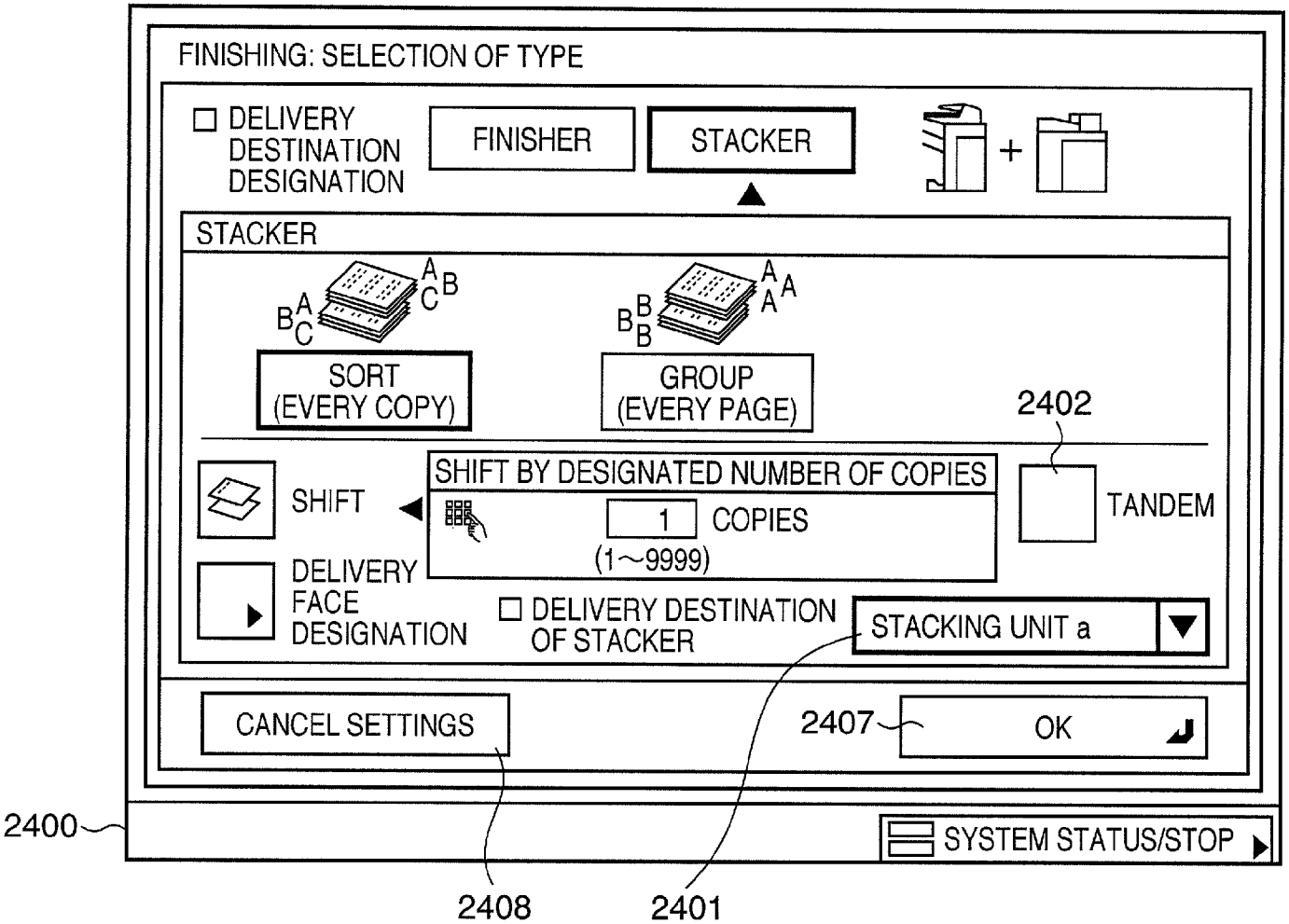
FIG. 14 is a view showing an example of an operation window displayed upon pressing a large-volume stacking key 709.

An operation window which exemplifies the copy function will be described. In copying, the control unit 205 displays a sheet processing type selection window 700 shown in FIG. 8. When the control unit 205 detects that the user has pressed the large-volume stacking key 709, it displays an operation window 2400 shown in FIG. 14. The operation window 2400 has a delivery destination key 2401 for setting a delivery destination, and a tandem key 2402 for setting tandem output. Tandem output uses the stack trays of both the large-volume stackers 200*a* and 200*b* as destinations when outputting a print job. In the window illustrated in FIG. 14, tandem output is OFF (tandem key 2402 is OFF), and a stacking unit a (to be described later) is selected with the delivery destination key 2401.

Figure 15:
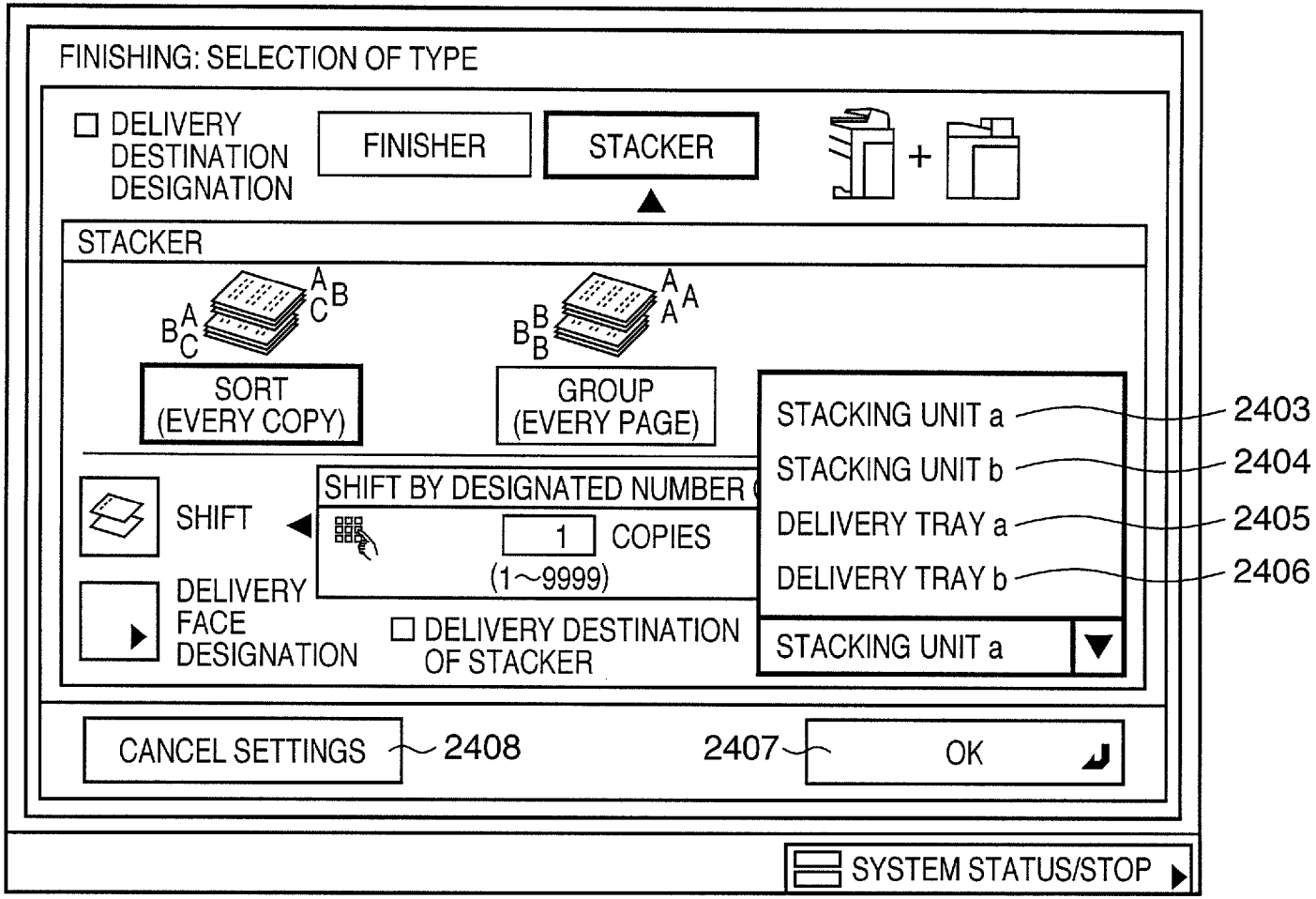
FIG. 15 is a view showing an example of a pull-down menu display when selecting a delivery destination.

When the control unit 205 determines that the user has pressed the delivery destination key 2401, it displays a pull-down menu as illustrated in FIG. 15. The pull-down menu represents delivery trays in the configuration of the printing apparatus 100. A stacking unit a 2403 represents the stack tray of the large-volume stacker 200*a*, and a stacking unit b 2404 represents the stack tray of the large-volume stacker 200*b*. A delivery tray a 2405 represents the sample tray of the saddle stitching apparatus 200*c*, and a delivery tray b 2406 represents the stack tray of the saddle stitching apparatus 200*c*.

Figure 16:
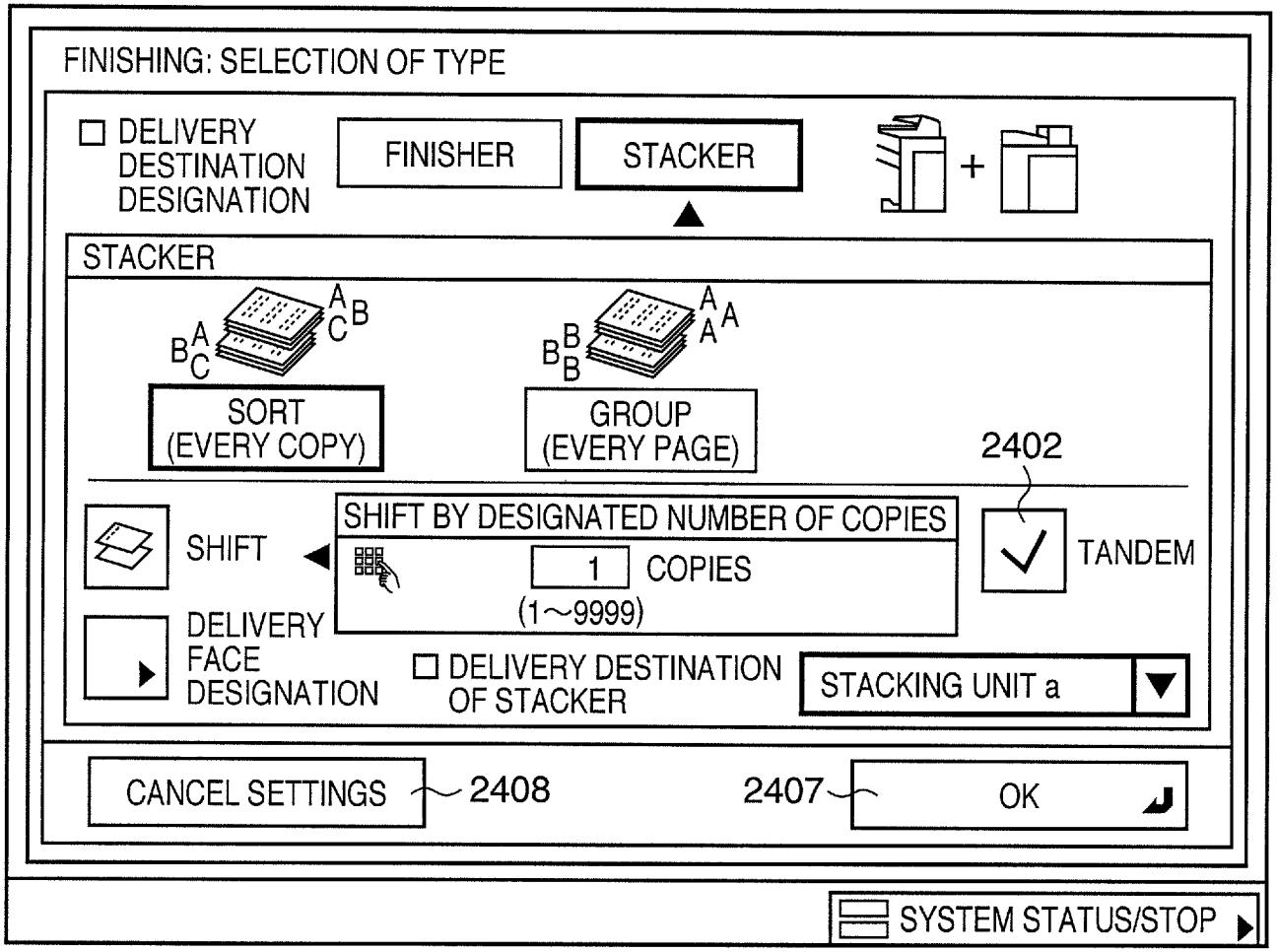
FIG. 16 is a view showing an example of an operation window displayed upon selecting a tandem key 2402.

When the control unit 205 detects that the user has selected the tandem key 2402, it displays an operation window illustrated in FIG. 16 on the touch panel unit 401. The tandem key is a toggle key indicating the tandem setting=ON when checked and the tandem setting=OFF when not checked.

After the above-described operation, if the control unit 205 detects that the user has pressed an OK key 2407, it writes and holds a set delivery destination and each tandem setting in the RAM 208 or HDD 209. When the control unit 205 detects that the user has pressed a setting cancel key 2408, it does not write, in the RAM 208 or HDD 209, a delivery destination and each tandem setting selected in the operation window.

Regardless of which of the OK key 2407 and setting cancel key 2408 has been pressed, the control unit 205 closes the operation window 2400 for setting large-volume stacking processing, and displays the sheet processing type selection window 700.

Figure 17:
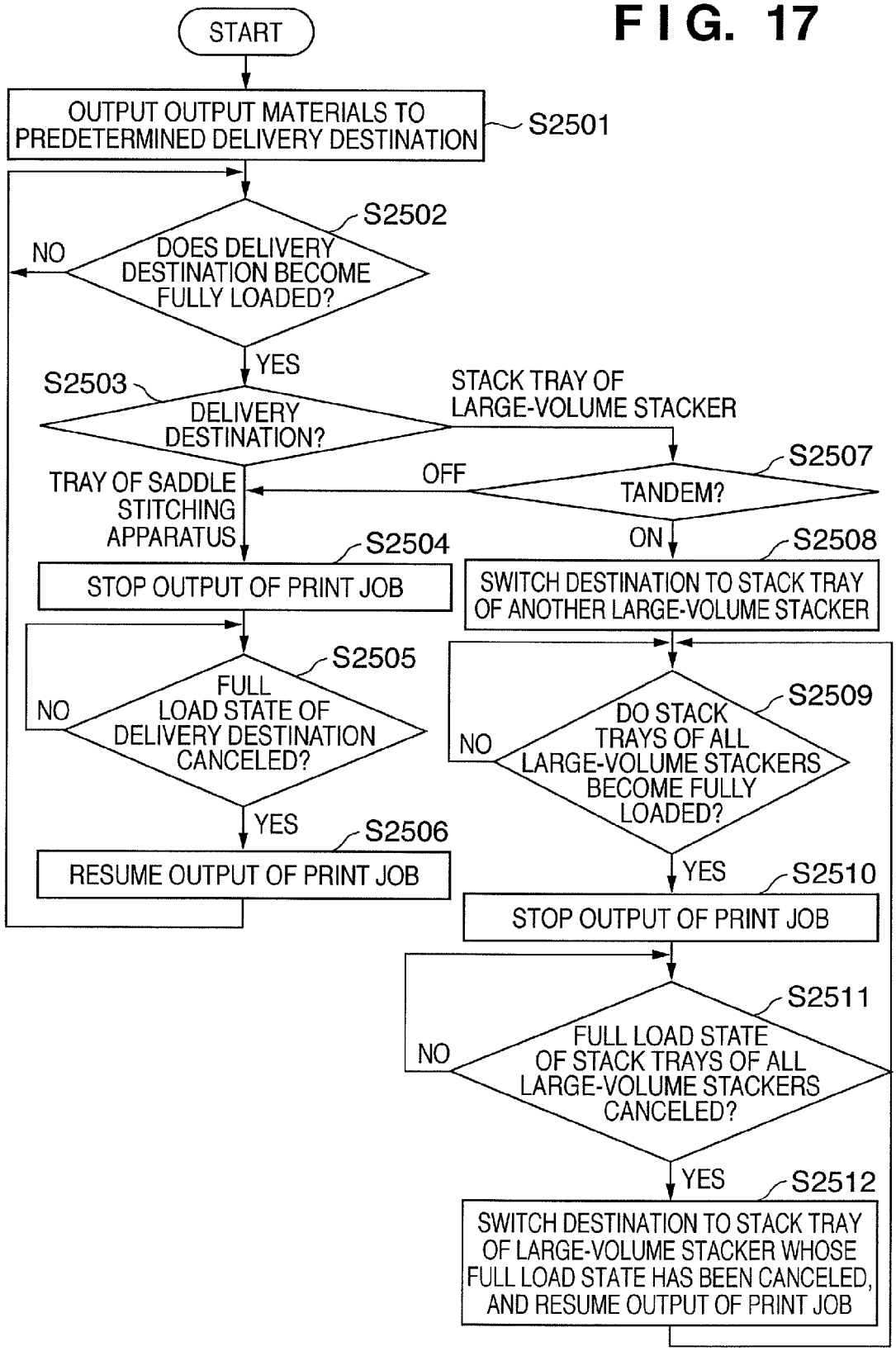
FIG. 17 is a flowchart showing processing to switch the setting of large-volume stacking processing and the stack tray.

Processing by the control unit 205 to switch the stack tray for the printing apparatus 100 based on the setting of large-volume stacking processing will be explained with reference to FIG. 17.

In S2501, at the start of a print job, the control unit 205 reads out a delivery destination setting made in the settings of large-volume stacking processing from the RAM 208 or HDD 209, and decides on the delivery destination of the output materials of the print job. In S2502, the control unit 205 processes the print job, and outputs the output materials to the delivery destination decided in S2501. At the same time, while continuing to output the print job, the control unit 205 communicates with the sheet processing apparatus at the destination via the external I/F 202 and monitors whether the destination has become fully loaded with the output materials. If the control unit 205 detects that the destination has become fully loaded with the output materials, it determines the fully loaded destination of the output materials in S2503. In this case, the control unit 205 determines one of the stack tray of the large-volume stacker 200*a*, the stack tray of the large-volume stacker 200*b*, and the sample tray and stack tray of the saddle stitching apparatus 200*c*.

If the control unit 205 determines in S2503 that the fully loaded delivery destination of the output materials is the sample tray or stack tray of the saddle stitching apparatus 200*c*, it stops the output operation of the print job in S2504. In S2505, the control unit 205 waits until the full load state of the tray with the output materials is canceled by, for example, removal of the output materials from the tray by the user. After the full load state of the tray with the output materials is canceled, the control unit 205 starts outputting the print job again in S2506.

If the control unit 205 determines in S2503 that the fully loaded delivery destination of the output materials is the stack tray of the large-volume stacker 200*a*, it advances the process to S2507. In S2507, the control unit 205 reads out a tandem setting made in the settings of large-volume stacking processing from the RAM 208 or HDD 209, and determines whether the tandem setting is ON or OFF. If the control unit 205 determines the tandem setting=OFF, it stops output of the print job in S2504, similar to output to the tray of the saddle stitching apparatus 200*c*. In S2505, the control unit 205 waits until the full load state is canceled. After the full load state is canceled, the control unit 205 starts outputting the print job again in S2506. By shifting to S2504 through "NO" in determination of S2507, the system 1000 executes the following control.

Assume that the large-volume stacker 200*a* becomes fully loaded while outputting the printed materials of a given job to the stacker 200*a*. That is, the printed materials cannot be output to the stacker 200*a* any more before outputting all the printed materials of the job to the stacker 200*a*. Further, assume that the target job is a job with the tandem setting=OFF (corresponding to a job which inhibits the use of the tandem function). In this case, the control unit 205 controls the system 1000 to inhibit continuation of printing of the job using the large-volume stacker 200*b* corresponding to another stacker and suspend printout of the job. Also in this case, the job is kept suspended until the printed materials are removed from the tray of the large-volume stacker 200*a*. The control unit 205 causes the printing apparatus 100 to resume printing of the job in response to cancellation of the full load state of the stack tray of the large-volume stacker 200*a*. The control unit 205 controls the system 1000 to output the printed materials of the job to the same stack tray of the stacker 200*a* as that before suspension.

If the control unit 205 determines that the tandem setting=ON in S2507, it switches the destination of the print job to the stack tray of the large-volume stacker 200*b*, and continues output of the print job in S2508. If the control unit 205 detects in S2509 that the stack trays of both the large-volume stackers 200*a* and 200*b* are fully loaded, it stops output of the print job in S2510. In S2511, the control unit 205 waits until the full load state of either the large-volume stacker 200*a* or 200*b* is canceled. If the full load state of either stack tray is canceled, the control unit 205 designates the available stack tray as the delivery destination, and resumes output of the print job in S2512. The control unit 205 continues the same process till the end of the print job. By shifting to S2508 through "YES" in determination of S2507, the system 1000 executes the following control.

Assume that the large-volume stacker 200*a* becomes fully loaded while outputting the printed materials of a given job to the stacker 200*a*, similar to the above-mentioned situation. That is, the printed materials cannot be output to the stacker 200*a* any more before outputting all the printed materials of the job to the stacker 200*a*. Further, assume that the target job is a job with the tandem setting=ON (corresponding to a job which permits the use of the tandem function). In this case, the control unit 205 permits continuation of printing of the job using the large-volume stacker 200*b* corresponding to another stacker. In this way, the control unit 205 controls the system 1000 so that the printing apparatus 100 continues printing of the job using the large-volume stacker 200*b* even while the full load state of the stack tray of the large-volume stacker 200*a* is not canceled.

In the embodiment, the front door of the large-volume stacker is open when taking out printed materials on the stack tray of the stacker.

The system 1000 according to the embodiment is configured to be able to supply printed materials from the printing apparatus into a succeeding sheet processing apparatus via the straight path (see FIG. 4 inside the large-volume stacker even while the front door of the stacker is kept open. The system 1000 may be configured to be able to execute the following control for a job requiring the use of the tandem function by utilizing this configuration.

Assume that the operator opens the front door of the stacker 200*a* in order to take out the printed materials of a job from the tray of the stacker 200*a*. The control unit 205 controls the system 1000 so that the printing apparatus 100 continues printing of the job requiring the use of the tandem function even while the front door of the stacker 200*a* is kept open. The control unit 205 controls the system 1000 to output the printed materials of the job from the printing apparatus 100 to the stack tray inside the stacker 200*b* via the straight path (see FIG. 4) inside the stacker 200*a*. This can increase the productivity of a job requiring the use of the tandem function.

If the control unit 205 determines in S2503 that the fully loaded delivery destination of the output materials is the stack tray of the large-volume stacker 200*b*, it executes the same processes as in S2508 to S2511. However, in the process of S2508, the control unit 205 switches the destination of the print job to the stack tray of the large-volume stacker 200*a*.

By setting a delivery destination and tandem output for each job, a sheet processing apparatus preparing for large-volume printing can be controlled. When no delivery destination of an input job is set, a sheet processing apparatus preparing for large-volume printing can be controlled similarly even with settings in the user mode.

Figure 18:
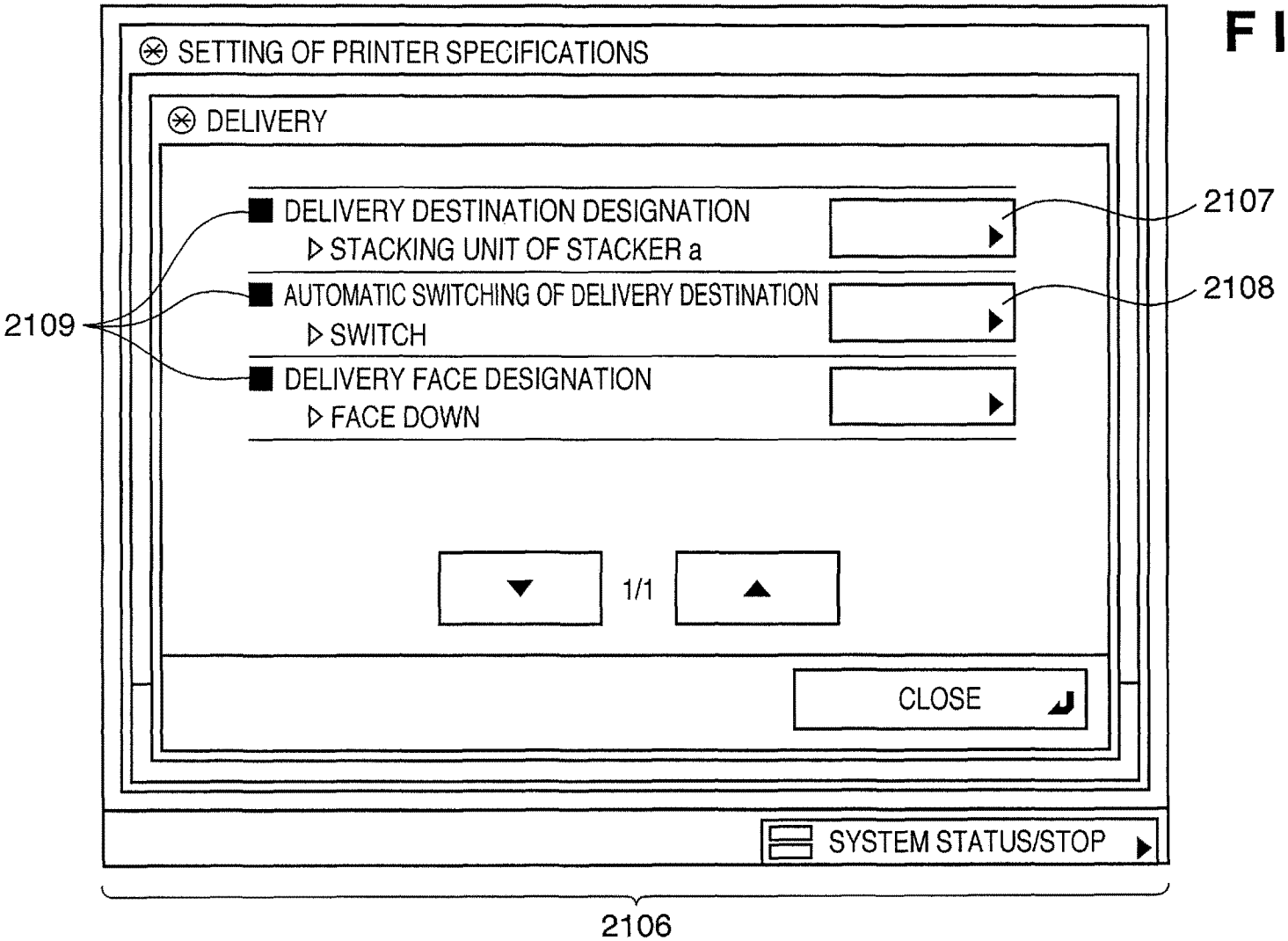
FIG. 18 is a view showing an example of a delivery destination designation window 2106 for setting of printer specifications.

When the user presses the user mode key 505 of the operation unit 204 regardless of whether printing of a job is in progress, the control unit 205 causes the touch panel unit 401 to display an operation window 2106 shown in FIG. 18 for a configuration in which a plurality of sheet processing apparatuses are connected.

Figure 19:
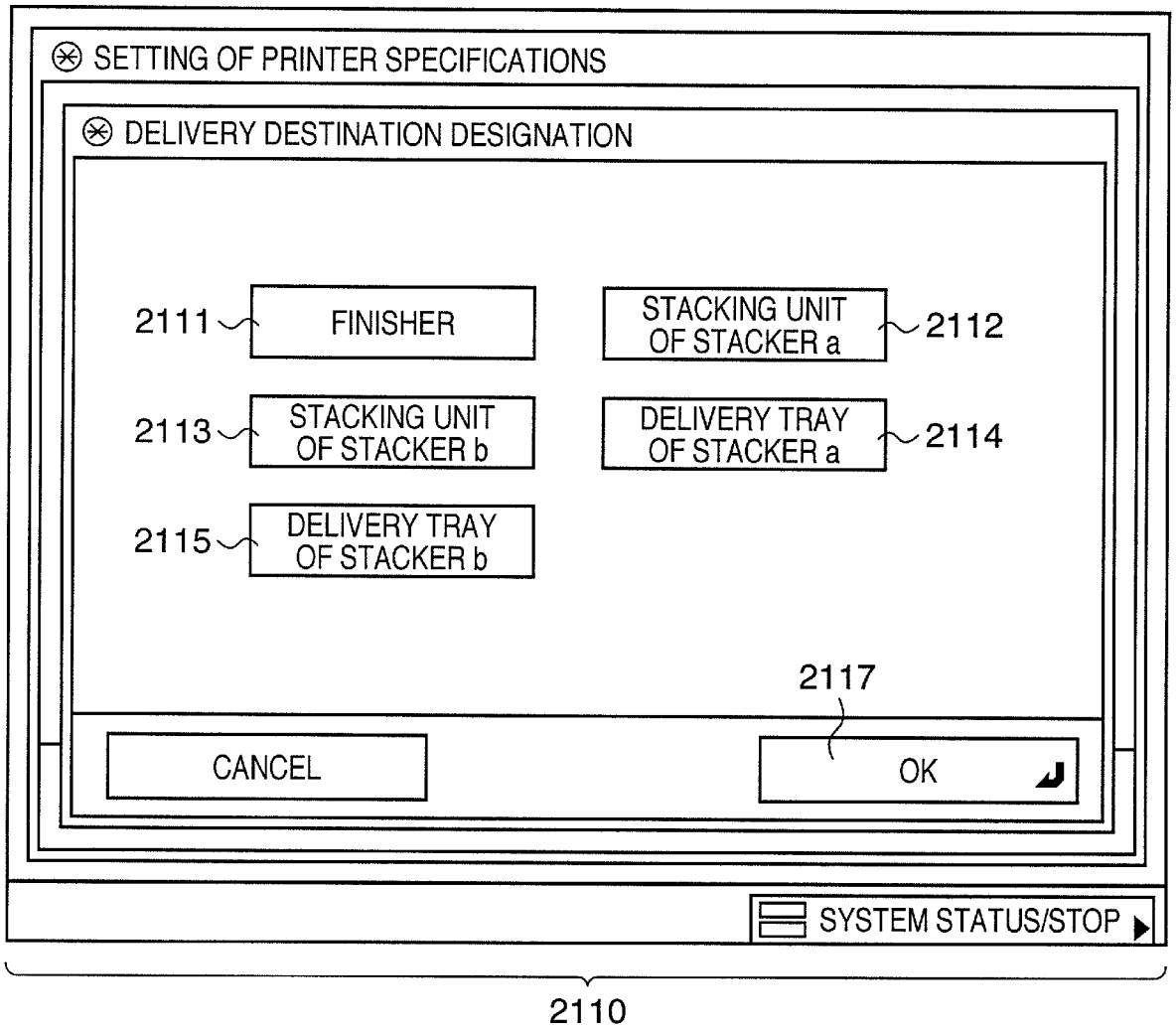
FIG. 19 is a view showing an example of a delivery destination designation window 2110 for setting of printer specifications.

When the user presses a delivery destination designation key 2107 in the operation window 2106, the control unit 205 detects that the user has pressed the delivery destination designation key 2107, and displays a delivery destination designation window 2110 illustrated in FIG. 19. The user can select in advance the priority delivery destination of a job whose delivery destination has not been designated upon inputting the job. The user selects one of priority delivery destination keys 2111 to 2115, and presses an OK key 2117. Then, the control unit 205 writes the selected priority delivery destination in the RAM 208 or HDD 209, and holds the setting of the priority delivery destination. The control unit 205 closes the delivery destination designation window 2110, and displays the operation window 2106 shown in FIG. 18.

At this time, the control unit 205 displays, as a setting value 2109 of the operation setting item in the operation window 2106, the priority delivery destination value which is designated in the delivery destination designation window 2110 and is written and held in the RAM 208 or HDD 209. When the held priority delivery destination value represents the large-volume stacker, the control unit 205 enables selection of an automatic delivery destination switching (tandem) key in the operation window 2106. When a value representing a destination other than the large-volume stacker is held, the control unit 205 disables selection of the automatic delivery destination switching (tandem) key.

Figure 20:
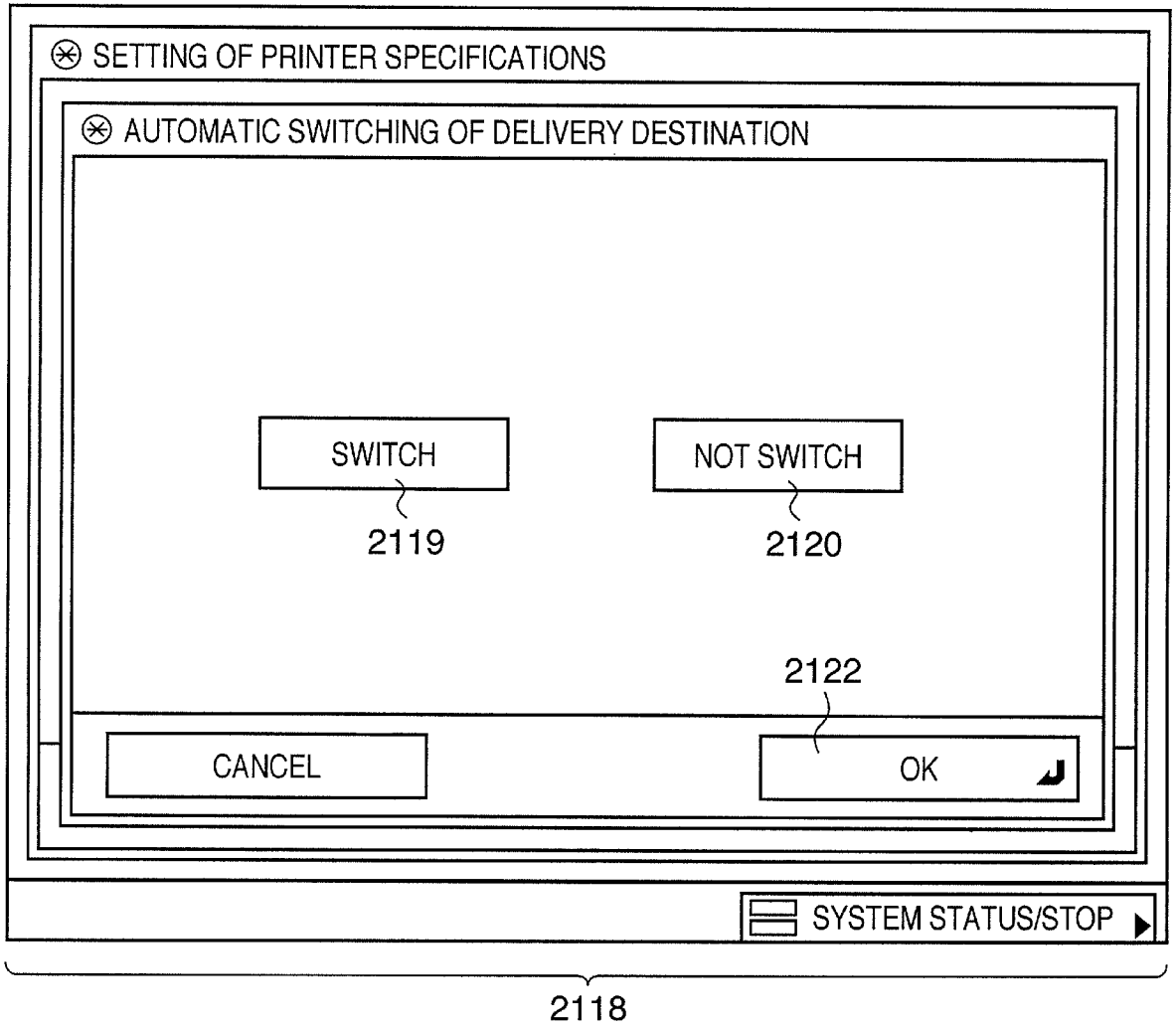
FIG. 20 is a view showing an example of an automatic delivery destination switching window 2118 for setting of printer specifications.

When the setting of the priority delivery destination represents the large-volume stacker and the user presses an automatic delivery destination switching key 2108 in the operation window 2106 of FIG. 18, the control unit 205 displays an automatic delivery destination switching window 2118 illustrated in FIG. 20. In the window 2118, the user can select whether to automatically "switch" (tandem) or "not switch" the delivery destination. If the user selects a "switch" key 2119 or "not switch" key 2120 and presses an OK key 2122, the control unit 205 writes and holds the setting of automatic delivery destination switching (tandem) in the RAM 208 or HDD 209.

After that, the process is done similarly to control by the control unit 205 to switch the stack tray for the printing apparatus 100 based on the setting of large-volume stacking processing after setting a delivery destination and tandem for each job.

A concrete example of processing executed by the control unit 205 for the above-described tandem output function will be explained.

For example, the control unit 205 controls to permit the use of the tandem output function when the configuration of the printing system 1000 corresponds to example 2 described above, and to inhibit the use of the tandem output function when the configuration corresponds to example 1.

Upon accepting an instruction to use the tandem output function, the control unit 205 recognizes that the target job is a "job requiring the use of the tandem function".

Upon accepting an instruction not to use the tandem output function, the control unit 205 recognizes that the target job is a "job inhibiting the use of the tandem function".

When the tandem function use instruction is set, the control unit 205 controls to allow setting the delivery destination of one of a plurality of large-volume stackers to which the printed materials of the target job are first output, together with the tandem function use setting.

This setting is premised on a case where only one large-volume stacker can stack all the printed materials of a job even when the use of a plurality of large-volume stackers by the tandem function is designated.

This setting also allows the user to explicitly decide which of large-volume stackers is used first when processing a job of many sheets that uses the delivery destinations of large-volume stackers to output the printed materials of one job.

This mechanism controls to allow starting print processing of a target job even when the user neither counts nor grasps the number of printed materials of the job. This mechanism allows designating the delivery destination of one of large-volume stackers in advance by making the above-described setting on the assumption that output may not be complete by one large-volume stacker.

Assume that a job for which the user designates a large-volume stacker as a printed material destination is, for example, a job requiring more than 5,000 print sheets to complete the print operation. In this case, the job cannot be completely processed using the delivery destination of only one large-volume stacker. In this case, according to the embodiment, the user is prompted to set either the large-volume stacker 200*a* or 200*b* in advance when receiving a tandem output function use instruction from the user.

A stacker used first can be arbitrarily designated for each target job. When the stacker used first becomes fully loaded, it is confirmed whether printed materials are outputtable to another stacker. If possible, the stacker is switched. A page immediately after a page output when the stacker designated first becomes fully loaded is output to another stacker, continuing output of the job. If the other stacker also becomes fully loaded before completely outputting the printed materials of the job, it is confirmed whether the printed materials are outputtable to the stacker designated first. For example, if the operator removes the printed materials from the stacker designated first during output of the printed materials to the other stacker, the stacker designated first becomes empty, and output of the job can continue.

When, however, the two stackers become fully loaded, output of the job is suspended until the stackers allow printout. In this case, the control unit 205 inhibits continuing the print operation of the job even if the printed materials are outputtable to the destination of the saddle stitching apparatus corresponding to the third inline finisher.

In this fashion, printing of a target job can be complete by alternately using two large-volume stackers while inhibiting the use of an inline finisher other than a large-volume stacker.

The system may be configured to be able to not only individually execute tandem output control for each job, but also execute it for each device without switching the control between jobs, as an initial setting of the printing apparatus.

Example 3

Still another control method for printing control of a sheet processing apparatus preparing for large-volume printing described in examples 1 and 2 will be explained.

When alternate output in stacker output=OFF in example 1, or the stack tray of the large-volume stacker is fully loaded in example 2, the control unit 205 controls to stop output of a print job until the full load state is canceled. Still another example will be described below.

Figure 21:
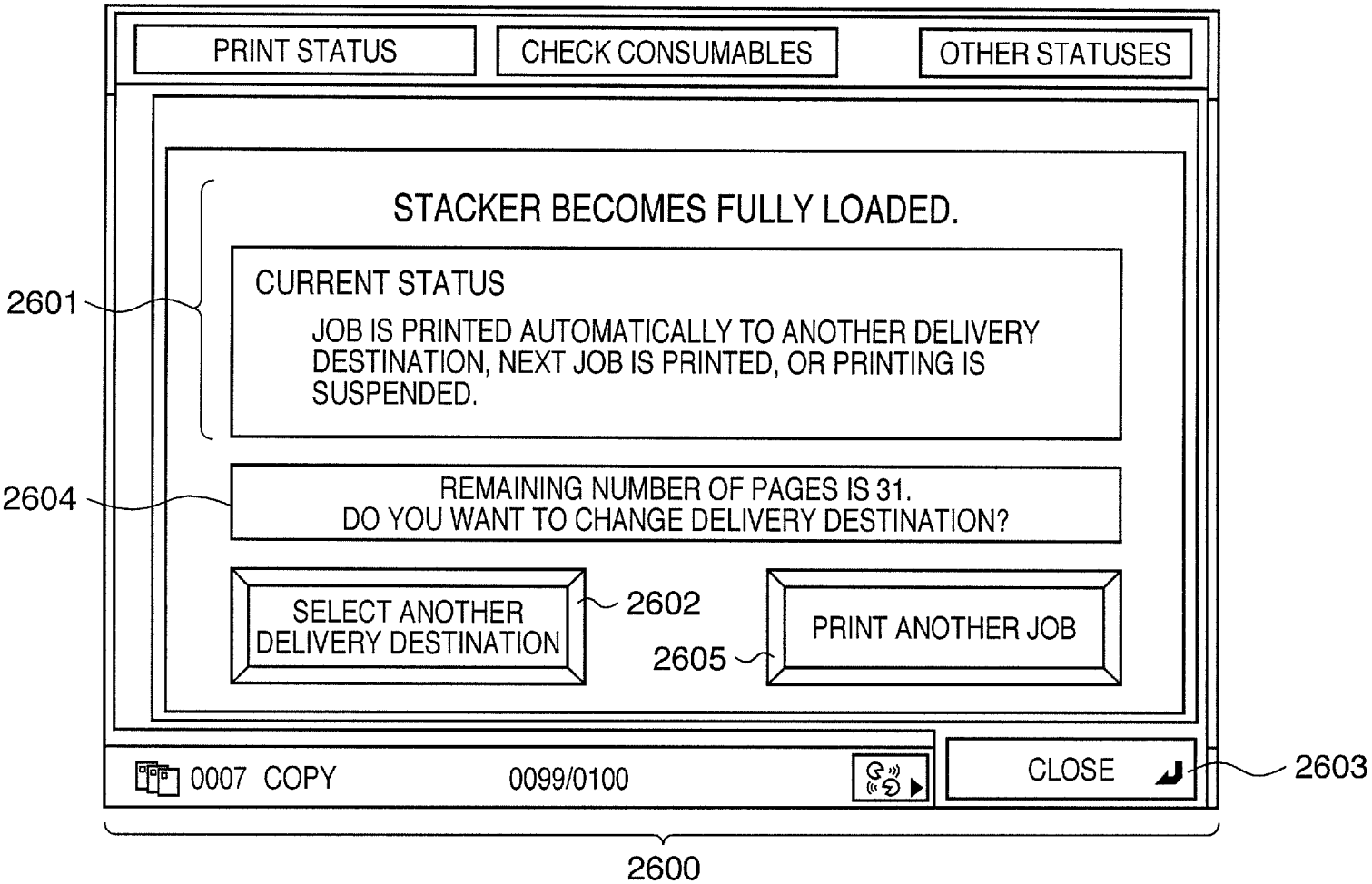
FIG. 21 is a view showing an example of a popup display presented when the stack tray of the large-volume stacker becomes fully loaded.

When the control unit 205 detects that alternate output in stacker output=OFF in example 1, or the stack tray of the large-volume stacker becomes fully loaded in example 2, it popup-displays an operation window 2600 illustrated in FIG. 21 on the touch panel unit 401. That is, the control unit 205 popup-displays the operation window 2600 on the touch panel unit 401 upon detecting the full load state in S2304 in example 1, determining tandem=OFF in S2507 in example 2, or detecting the full load state in S2509. Since the stack tray of the large-volume stacker is fully loaded, the operation window 2600 displays a message 2601 that output of the print job stops. The operation window 2600 also has a key 2602 to select another delivery destination and designate subsequent processing procedures.

Figure 22:
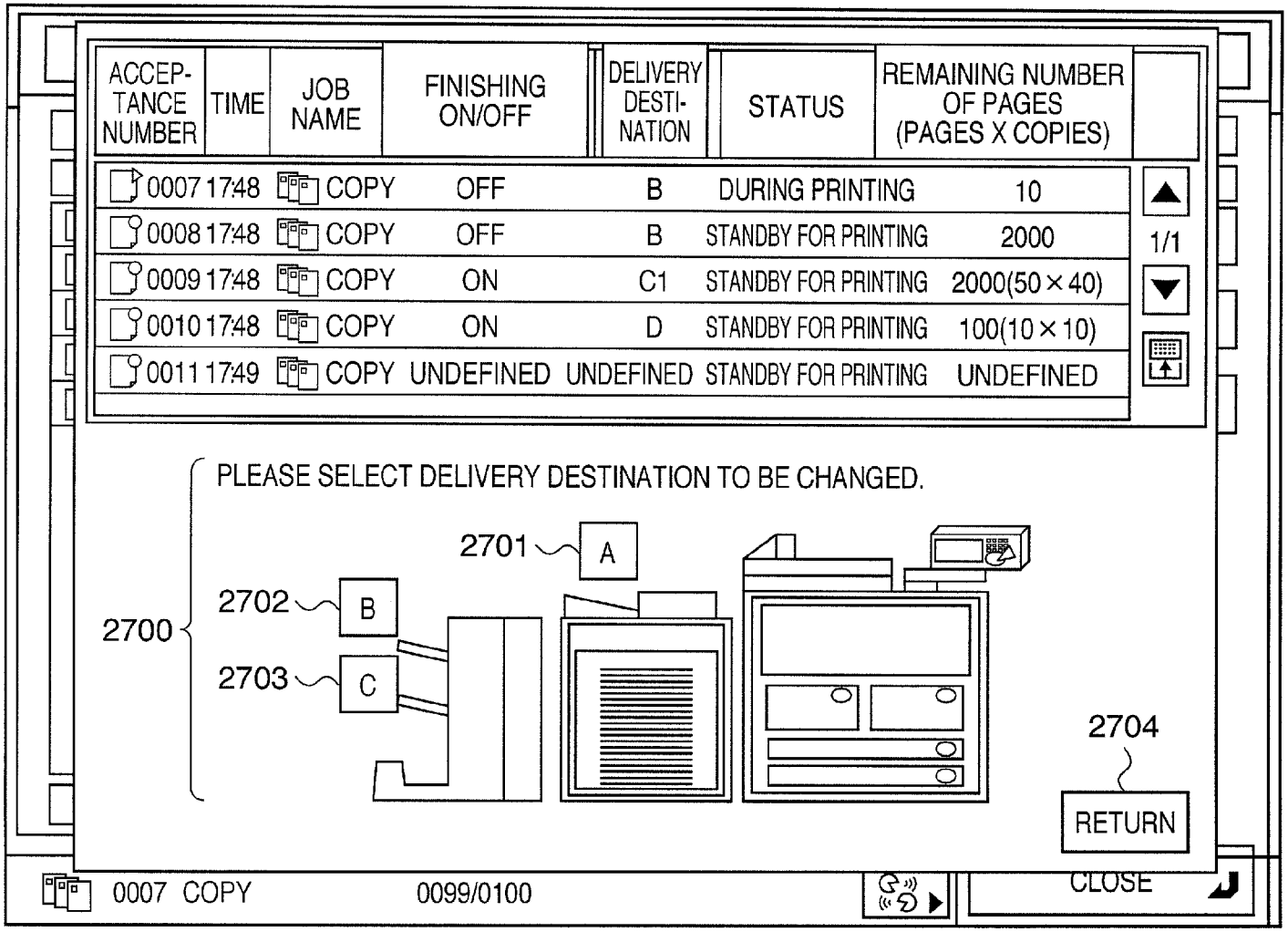
FIG. 22 is a view showing an example of a delivery destination selection window 2700 displayed when selecting another delivery destination.

When the control unit 205 detects that the user has pressed the selection key 2602 in the operation window 2600, it displays a delivery destination selection window 2700 illustrated in FIG. 22. The delivery destination selection window 2700 allows the user to select a delivery destination other than the stack tray. In this example, the delivery destination selection window 2700 displays an escape tray A 2701 of the large-volume stacker 200*a*, and a sample tray B 2702 and stack tray C 2703 of the saddle stitching apparatus.

When the control unit 205 detects that the user has selected one of the escape tray A 2701, sample tray B 2702, and stack tray C 2703 as another delivery destination in the delivery destination selection window 2700, it closes the delivery destination selection window 2700. At the same time, the control unit 205 switches the destination of a print job to the delivery destination selected in the delivery destination selection window 2700, and resumes the suspended output of the print job.

When the control unit 205 detects that the user has pressed a return key 2704 in the delivery destination selection window 2700, it returns the display to the operation window 2600. Further, when the control unit 205 detects that the user has pressed a close key 2603 in the operation window 2600, it closes the operation window 2600, and waits until the full load state of the stack tray of the large-volume stacker is canceled.

The operation window 2600 is popup-displayed when the stack tray of the large-volume stacker becomes fully loaded. Alternatively, the operation window 2600 may be popup-displayed before output of a print job stops, that is, when the stack tray of the large-volume stacker becomes almost fully loaded. In this case, the control unit 205 popup-displays the operation window 2600 when the stack tray of the large-volume stacker becomes almost fully loaded. If the user selects another delivery destination before the stack tray of the large-volume stacker becomes fully loaded, the controller unit continues output of the print job by switching the delivery destination without stopping the output when the stack tray of the large-volume stacker becomes fully loaded.

The operation window 2600 may provide a display 2604 representing the remaining number of output sheets of the print job so that the user can easily determine whether to select another delivery destination or whether to cancel the full load state of the stack tray and output printed materials again to the stack tray.

The operation window 2600 may provide a key 2605 to print another job so as to output another job while the user takes out sheets from the stack tray and sets another vacant dolly. In this case, when the control unit 205 detects that the user has pressed the key 2605, it searches queued jobs for a job requiring a delivery destination other than the stack tray of the large-volume stacker. Then, the control unit 205 prints out the job to the delivery destination other than the stack tray of the large-volume stacker.

Further, when displaying the delivery destination selection window 2700, the control unit 205 may allow the user to confirm the delivery destination of a queued job and select another delivery destination except for the delivery destination of the queued job.

Assume that the operator opens the front door of the large-volume stacker in which the printed materials of a job whose printing is suspended due to the full load state of the stack tray are stacked.

According to the embodiment, even in this situation, similar to the above-described situation, the control unit 205 controls the system 1000 so that the printing apparatus 100 can print a succeeding job corresponding to a job requiring a delivery destination different from the stacker. The control unit 205 controls the system 1000 to output the printed materials of the succeeding job from the printing apparatus 100 to the destination of a succeeding sheet processing apparatus via the straight path (see FIG. 4) inside the stacker 200*a* even while the front door is kept open.

In this manner, the control unit 205 can cause the printing apparatus 100 to execute printing of a succeeding job while suspending printing of a job which inhibits the use of the tandem function. This can increase the productivity of all jobs even when no tandem function is used.

Example 4

Another processing example when the stack tray of the large-volume stacker becomes fully loaded with outputs and its full load state is canceled during output to another delivery destination in examples 1 and 3 will be described.

Figure 23:
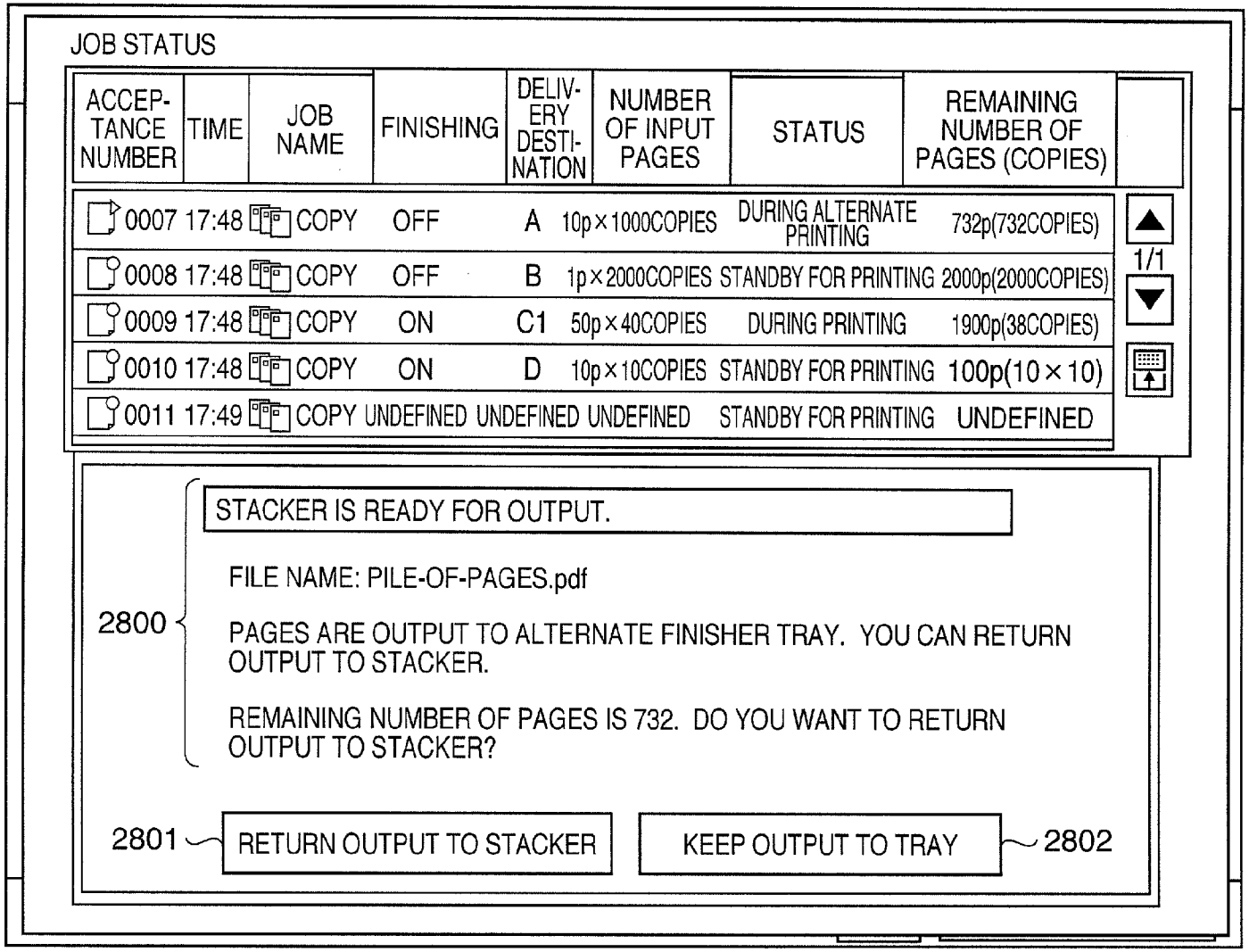
FIG. 23 is a view showing an example of a stacker output ready window 2800.

The control unit 205 displays a stacker output ready window 2800 illustrated in FIG. 23 at one of the following timings during output to another delivery destination after the stack tray of the large-volume stacker becomes fully loaded with outputs.

- Timing when it is detected in S2307 in example 1 that the full load state of the stack tray of the large-volume stacker is canceled.
- Timing when it is detected that the full load state of the stack tray of the large-volume stacker is canceled during output to another delivery destination owing to the full load state of the stack tray of the large-volume stacker after tandem=OFF is determined in S2507 in example 3.
- Timing when it is detected that the full load state of the stack tray of the large-volume stacker is canceled during output to another delivery destination after the full load state is detected in S2509 in example 3.

When two large-volume stackers are connected and the tandem setting=ON, like example 2, it is also possible to keep output to the stack tray of another large-volume stacker instead of displaying the stacker output ready window 2800.

The stacker output ready window 2800 has a key 2801 to return output to the stacker, and a key 2802 to keep output to the tray.

When the control unit 205 detects that the user has pressed the key 2801, it closes the stacker output ready window 2800. At the same time, the control unit 205 switches the delivery destination of the print job to the stack tray of the large-volume stacker, and outputs the print job.

Upon detecting that the user has pressed the key 2802, the control unit 205 only closes the stacker output ready window 2800 without switching the delivery destination of the print job to the stack tray of the large-volume stacker.

The stacker output ready window 2800 may display the total number of output sheets of the print job or the number of printed sheets when the full load state of the stack tray is canceled. From this display, the user can easily determine whether to return output to the stack tray of the large-volume stacker, or keep output to another delivery destination other than the stack tray of the large-volume stacker.

Example 5

Another processing example different from example 4 when the stack tray of the large-volume stacker becomes fully loaded with outputs and its full load state is canceled during output to another delivery destination in examples 1 and 3 will be described.

When the control unit 205 detects that the stack tray of the large-volume stacker becomes fully loaded with outputs and its full load state is canceled during output to another delivery destination, it determines the remaining number of output sheets of the print job. If the control unit 205 determines that the remaining number of output sheets of the print job is larger than the number of sheets, held in the RAM 208 or HDD 209, which are to be output again to the stack tray of the large-volume stacker, it returns the destination of the print job to the stack tray of the large-volume stacker.

If the control unit 205 determines that the remaining number of sheets of the print job is smaller than the number of sheets which are to be output again to the stack tray of the large-volume stacker, it keeps output to another delivery destination without returning the destination of the print job to the stack tray of the large-volume stacker.

The number of sheets which are to be output again to the stack tray of the large-volume stacker may be set in the user mode or designated together with a job.

Effects which can be obtained by the above-described printing system 1000 according to the embodiment will be illustrated below.

To make the delivery tray empty, the large-volume stacker must execute the following operation until the operator takes out sheets from the stack tray and sets an empty dolly. This operation is more cumbersome and takes a longer time than an operation to remove output sheets from the tray of the saddle stitching apparatus. This operation is an operation to lift down the stack tray, open the door, extract the dolly, set an empty dolly, close the door, and lift up the stack tray. However, according to the embodiment, the print operation can continue even while sheets are taken out from the stack tray of the large-volume stacker, increasing the productivity.

In an environment where there are a plurality of large-volume stackers, post-processing is determined in accordance with the number of dollies possessed by the user or for each large-volume stacker. One print job is output using the stack tray of only one large-volume stacker. Alternatively, the stack trays of large-volume stackers can be switched and used for one print job. By this switching, the printing system 1000 can flexibly deal with the use of large-volume stackers in accordance with the user environment. When outputting one print job using the stack trays of large-volume stackers, the operator need not exchange dollies, increasing both productivity and operability.

Moreover, the user can designate a delivery tray used for alternate output when the stack tray of the large-volume stacker becomes fully loaded. The user can always recognize the destination of output materials during alternate output. In addition, the user can select whether to continue output to the alternate destination or return output to the stack tray of the large-volume stacker when an empty dolly is set during alternate output.

By properly displaying the output status such as the remaining number of sheets of a print job when prompting the user to make selection, the user can make determination without impairing productivity and operability.

[Other Mechanisms]

A computer (e.g., the PC 103 or 104) may achieve the functions shown in the drawings in the embodiment in accordance with an externally installed program. In this case, data for displaying the same operation windows as those described in the embodiment including operation windows are externally installed to provide various user interface windows on the display of the computer. For example, this has been described with reference to a configuration based on the UI window shown in FIG. 10. In this configuration, the present invention is also applicable to a case where pieces of information including a program are supplied to an output apparatus from a storage medium such as a CD-ROM, flash memory, or FD, or from an external storage medium via a network.

As described above, a storage medium which records software program codes for implementing the functions of the above-described embodiment is supplied to a system or apparatus. The computer (CPU or MPU) of the system or apparatus reads out and executes the program codes stored in the storage medium, achieving the object of the present invention. In this case, the program codes read out from the storage medium implement new functions of the present invention, and the storage medium which stores the program codes constitutes the present invention.

The program form is arbitrary such as an object code, a program executed by an interpreter, or script data supplied to an OS as long as a program function is attained.

The storage medium for supplying the program includes a flexible disk, hard disk, optical disk, magnetooptical disk, MO, CD-ROM, CD-R, CD-RW, magnetic tape, nonvolatile memory card, ROM, and DVD. In this case, the program codes read out from the storage medium implement the functions of the above-described embodiment, and the storage medium which stores the program codes constitutes the present invention.

As another program supply method, a client computer connects to an Internet homepage via the browser of the client computer. Then, the computer program of the present invention or a compressed file containing an automatic installing function is downloaded from the homepage to a recording medium such as a hard disk, thereby supplying the program. The program can also be implemented by grouping program codes which form the program of the present invention into a plurality of files, and downloading the files from different homepages. That is, claims of the present invention also incorporate a WWW server, FTP server, and the like which prompt a plurality of users to download the program files for implementing functional processes of the present invention by a computer.

The program of the present invention can be encrypted, stored in a storage medium such as a CD-ROM, and distributed to a user. A user who satisfies predetermined conditions is prompted to download decryption key information from a homepage via the Internet. The user executes the encrypted program using the key information, and installs the program in the computer.

The functions of the embodiment are implemented when the computer executes the readout program codes. Also, the functions of the embodiment are implemented when an OS (Operating System) or the like running on the computer performs some or all of actual processes on the basis of the instructions of the program codes.

The program codes read out from the storage medium may be written in the memory of a function expansion board inserted into the computer or the memory of a function expansion unit connected to the computer. After that, the CPU of the function expansion board or function expansion unit performs some or all of actual processes on the basis of the instructions of the program codes. These processes also implement the functions of the above-described embodiment.

The present invention may be applied to a system including a plurality of devices or an apparatus formed by a single device. The present invention can also be achieved by supplying a program to the system or apparatus. In this case, the system or apparatus can obtain the effects of the present invention by providing, to the system or apparatus, a storage medium which stores a program represented by software for achieving the present invention.

The present invention is not limited to the above-described embodiment, and various modifications (including organic combinations of embodiments) can be made without departing from the gist of the invention, and are not excluded from the scope of the invention. For example, in the embodiment, the control unit 205 in the printing apparatus 100 serves as a main controller for various control operations. Instead, an external controller in a housing different from the printing apparatus 100 may also execute some or all of various control operations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-223514, filed Aug. 18, 2006, which is hereby incorporated by reference herein in its entirety.

What is claimed is:

1. A printing system comprising:

an image forming apparatus configured to form images on sheets;

a first sheet stacking apparatus including a first stacking tray to which sheets conveyed from the image forming apparatus are discharged;

a second sheet stacking apparatus provided at a downstream side of the first sheet stacking apparatus in a conveyance direction of sheets, and including a second stacking tray to which sheets conveyed from the image forming apparatus are discharged;

a post-processing apparatus provided at a downstream side of the second sheet stacking apparatus in the conveyance direction, and including a post-processing device configured to perform post-processing to sheets conveyed from the image forming apparatus and a third stacking tray to which sheets, to which the post-processing has been performed by the post-processing device, are discharged, wherein the post-processing includes saddle stitching;

a receiving device configured to receive a print job in which one of the first stacking tray, the second stacking tray, or the third stacking tray is designated as a delivery destination of sheets on which images are formed by the image forming apparatus; and a controller configured to control, based on the print job received by the receiving device, the image forming apparatus to form images on sheets, wherein the controller is configured to obtain information indicating permission or inhibition for automatically changing the delivery destination, and wherein the controller is configured to control the delivery destination, based on the obtained information, so as to:

(i) in a case where one stacking tray of the first stacking tray or the second stacking tray is designated as the delivery destination in the received print job and the obtained information indicates permission to change the delivery destination, continue execution of the print job by changing the delivery destination to the other stacking tray of the first stacking tray or the second stacking tray, in response to detecting a fully loaded state of the one stacking tray designated as the delivery destination, (ii) in a case where one stacking tray of the first stacking tray or the second stacking tray is designated as the delivery destination in the received print job and the obtained information indicates inhibition to change the delivery destination, suspend the execution of the received print job until sheets on the one stacking tray designated as the delivery destination are removed, in response to detecting a fully loaded state of the one stacking tray, and (iii) in a case where the third stacking tray is designated as the delivery destination in the received print job, suspend the execution of the received print job until sheets on the third stacking tray are removed, in response to detecting a fully loaded state of the third stacking tray, regardless of whether the information indicates permission or inhibition of changing the delivery destination.

2. The system according to claim 1, wherein each of the first sheet stacking apparatus and the second sheet stacking apparatus includes a large-volume stacker.

3. The system according to claim 1, wherein each of the first sheet stacking apparatus and the second sheet stacking apparatus has a dolly.

4. The system according to claim 1, wherein the post-processing apparatus includes a saddle stitching apparatus.

5. The system according to claim 1, wherein the post-processing apparatus includes a glue binding apparatus.

6. The system according to claim 1, wherein the post-processing includes stapling.

7. The system according to claim 1, wherein the post-processing includes punching.

8. The system according to claim 1, wherein the post-processing includes folding.

9. The system according to claim 1, wherein the post-processing includes shift delivery.

10. The system according to claim 1, wherein the post-processing includes cutting.

11. The system according to claim 1, wherein the post-processing includes case binding.

12. The system according to claim 1, wherein the post-processing includes pad binding.

13. The system according to claim 1, wherein the information indicating permission or inhibition for changing the delivery destination is set for each print job.

14. The system according to claim 1, wherein the information indicating permission or inhibition for changing the delivery destination is set irrespective of the print job.

15. The system according to claim 1, wherein the print job is received from an external device through a network.

16. The system according to claim 1, wherein the print job is received from a scanner which reads a document image.

17. The system according to claim 1, wherein the controller notifies, to a user, that the delivery destination was changed.

18. The system according to claim 1, wherein the controller notifies the changed delivery destination to a user.

19. The system according to claim 1, wherein, in a case where the delivery destination is changed from one stacking tray of the first stacking tray or the second stacking tray to the other stacking tray of the first stacking tray or the second stacking tray, after the fully loaded state of the one stacking tray designated as the delivery destination in the print job is cancelled, the controller controls conveying the sheets, on which images have been formed by the image forming apparatus, to the one stacking tray designated as the delivery destination in the print job.

20. An image forming apparatus which is connectable to a first sheet stacking apparatus, a second sheet stacking apparatus provided at a downstream side of the first sheet stacking apparatus in a conveyance direction of sheets, and a post-processing apparatus provided at a downstream side of the second sheet stacking apparatus in the conveyance direction, wherein the first sheet stacking apparatus includes a first stacking tray to which sheets conveyed from the image forming apparatus are discharged, the second sheet stacking apparatus includes a second stacking tray to which sheets conveyed from the image forming apparatus are discharged, and the post-processing apparatus includes a post-processing device configured to perform post-processing to sheets conveyed from the image forming apparatus and a third stacking tray to which sheets, to which the post-processing has been performed by the post-processing device, are discharged, the image forming apparatus comprising:

a receiving device configured to receive a print job in which one of the first stacking tray, the second stacking tray, or the third stacking tray is designated as a delivery destination of sheets on which images are formed; and a controller configured to control forming image on the sheets, based on the print job received by the receiving device, wherein the controller is configured to obtain information indicating permission or inhibition for automatically changing the delivery destination, and wherein the controller is configured to control the delivery destination, based on the obtained information, so as to:

(i) in a case where one stacking tray of the first stacking tray or the second stacking tray is designated as the delivery destination in the received print job and the obtained information indicates permission to change the delivery destination, continue execution of the print job by changing the delivery destination to the other stacking tray of the first stacking tray or the second stacking tray, in response to detecting a fully loaded state of the one stacking tray designated as the delivery destination, (ii) in a case where one stacking tray of the first stacking tray or the second stacking tray is designated as the delivery destination in the received print job and the obtained information indicates inhibition to change the delivery destination, suspend the execution of the received print job until sheets on the one stacking tray designated as the delivery destination are removed, in response to detecting a fully loaded state of the one stacking tray, and (iii) in a case where the third stacking tray is designated as the delivery destination in the received print job, suspend the execution of the received print job until sheets on the third stacking tray are removed, in response to detecting a fully loaded state of the third stacking tray, regardless of whether the information indicates permission or inhibition of changing the delivery destination.

* * * * *